US011578850B2

(12) United States Patent
Miyairi

(10) Patent No.: US 11,578,850 B2
(45) Date of Patent: Feb. 14, 2023

(54) LIGHTING DEVICE

(71) Applicant: NICHIA CORPORATION, Anan (JP)

(72) Inventor: Hiroshi Miyairi, Yokohama (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/556,012

(22) Filed: Dec. 20, 2021

(65) Prior Publication Data

US 2022/0196219 A1 Jun. 23, 2022

(30) Foreign Application Priority Data

Dec. 22, 2020 (JP) ..... JP2020-212374

(51) Int. Cl.

| | |
|---|---|
| ***F21S 41/16*** | (2018.01) |
| ***F21S 41/33*** | (2018.01) |
| ***F21S 41/25*** | (2018.01) |
| ***F21S 41/148*** | (2018.01) |

(52) U.S. Cl.

CPC ..... *F21S 41/33* (2018.01); *F21S 41/148* (2018.01); *F21S 41/16* (2018.01); *F21S 41/25* (2018.01)

(58) Field of Classification Search

None

See application file for complete search history.

(56) References Cited

U.S. PATENT DOCUMENTS

| | | | | |
|---|---|---|---|---|
| 2003/0076686 | A1* | 4/2003 | Ishida | F21S 41/33 362/539 |
| 2004/0202007 | A1* | 10/2004 | Yagi | F21V 29/74 362/523 |
| 2005/0219856 | A1 | 10/2005 | Tatsukawa | |
| 2011/0267832 | A1 | 11/2011 | Sekiguchi | |
| 2014/0268846 | A1 | 9/2014 | Nakazato | |
| 2015/0241008 | A1 | 8/2015 | Matsumoto et al. | |
| 2017/0158113 | A1 | 6/2017 | Kanayama et al. | |
| 2017/0227184 | A1 | 8/2017 | Ishida et al. | |

FOREIGN PATENT DOCUMENTS

| | | | |
|---|---|---|---|
| JP | 2004-241142 | A | 8/2004 |
| JP | 2005-294176 | A | 10/2005 |
| JP | 2014-010968 | A | 1/2014 |
| JP | 2014-180886 | A | 9/2014 |
| JP | 2015-076243 | A | 4/2015 |
| JP | 2015-173096 | A | 10/2015 |
| JP | 2016-039021 | A | 3/2016 |
| JP | 2017-103189 | A | 6/2017 |
| JP | 2017-195061 | A | 10/2017 |
| JP | 2017-208196 | A | 11/2017 |

* cited by examiner

*Primary Examiner* — Elmito Breval

(74) *Attorney, Agent, or Firm* — Foley & Lardner LLP

(57) ABSTRACT

A lighting device includes: a light source having a light-emitting surface; a reflector having a reflective surface configured to reflect light emitted from the light source; and a lens on which light reflected by the reflective surface is incident. The reflective surface is composed of a portion of a spheroidal surface that includes a first focal point located on the light-emitting surface and a second focal point located between the reflective surface and the lens. The reflective surface intersects a major axis of the spheroidal surface. A value obtained by dividing a first distance, which is a distance between the first focal point and the second focal point, by a second distance, which is a distance between the first focal point and an intersection point of the reflective surface and the major axis, is 7 or greater.

17 Claims, 11 Drawing Sheets

LIGHTING DEVICE

CROSS-REFERENCE TO RELATED APPLICATION

This application claims priority to Japanese Patent Application No. 2020-212374, filed on Dec. 22, 2020, the disclosure of which is hereby incorporated by reference in its entirety.

BACKGROUND

The embodiments described in this application relate to a lighting device.

There is known a lighting device that includes a light source, a reflector configured to reflect light emitted from the light source, and a lens on which the light reflected by the reflector is incident (See, for example, Japanese Patent Publication No. 2017-208196).

SUMMARY

An object of certain embodiments is to provide a lighting device in which a size of a lens can be reduced.

A lighting device according to an embodiment includes a light source having a light-emitting surface; a reflector having a reflective surface configured to reflect light emitted from the light source; and a lens on which light reflected by the reflective surface is incident. The reflective surface is composed of a portion of a spheroidal surface that includes a first focal point located on the light-emitting surface and a second focal point located between the reflective surface and the lens. The reflective surface intersects a major axis of the spheroidal surface. A value obtained by dividing a first distance by a second distance is 7 or greater. The first distance is a distance between the first focal point and the second focal point. The second distance is a distance between the first focal point and an intersection point of the reflective surface and the major axis. A maximum dimension of the lens in a first direction in which a normal line extends at a center of the light-emitting surface is 20 mm or less.

A lighting device according to an embodiment includes a light source having a light-emitting surface, a reflector having a reflective surface configured to reflect light emitted from the light source, and a lens on which light reflected by the reflective surface is incident. The reflective surface has a shape obtained by combining portions of outer peripheries of a plurality of ellipses. A first focal point of each of the plurality of ellipses is located on the light-emitting surface. A second focal point of each of the plurality of ellipses is located between the reflective surface and the lens. A major axis of, among the plurality of ellipses, a first ellipse and the reflective surface intersect each other, wherein the first ellipse has the shortest distance between the first focal point and the second focal point. A value obtained by dividing a first distance and a second distance is 7 or greater. The first distance is a distance between the first focal point and the second focal point of the first ellipse. The second distance is a distance between the first focal point of the first ellipse and an intersection point of the reflective surface and the major axis. The maximum dimension of the lens in a first direction in which a normal line extends at the center of the light-emitting surface is 20 mm or less.

According to the embodiments, it is possible to provide a lighting device in which a size of a lens can be reduced.

DETAILED DESCRIPTION

First Embodiment

A first embodiment will be described.

Figure 1:
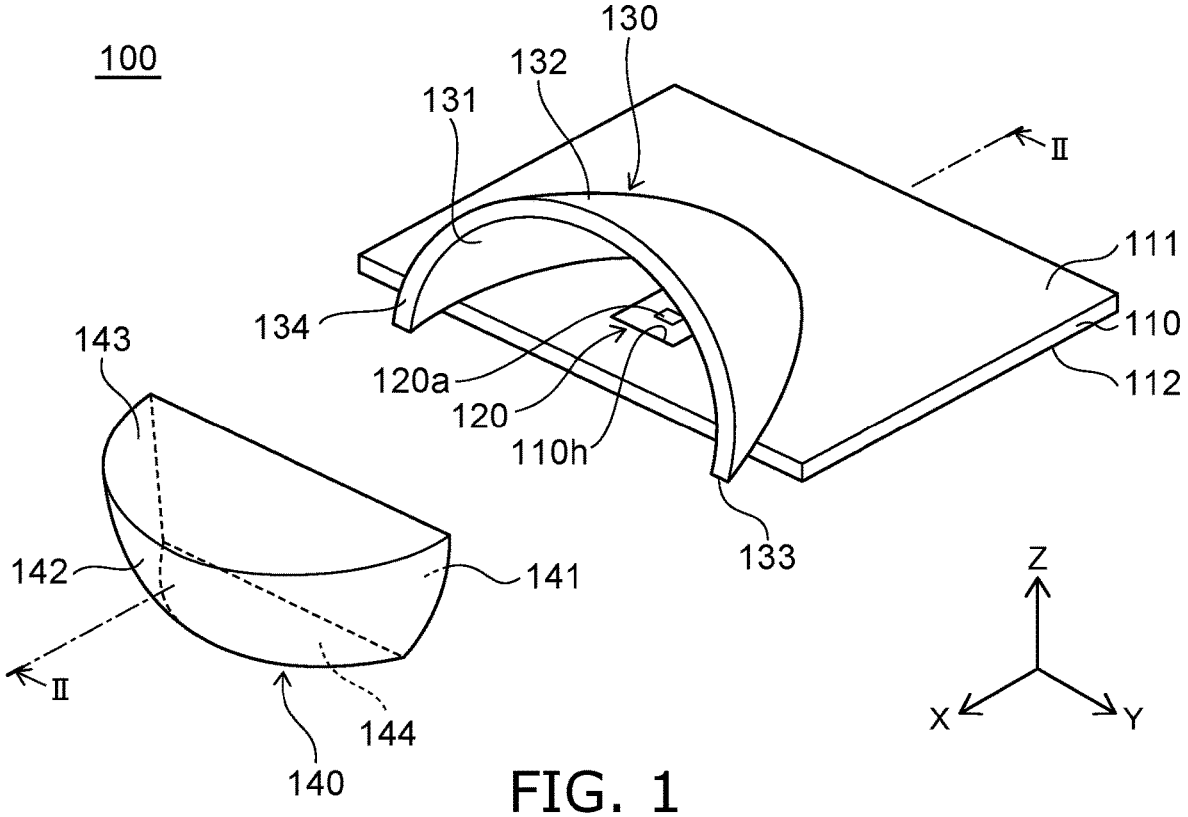
FIG. 1 is a schematic perspective view illustrating a lighting device according to a first embodiment.

FIG. 1 is a schematic perspective view illustrating a lighting device according to the present embodiment.

Figure 2:
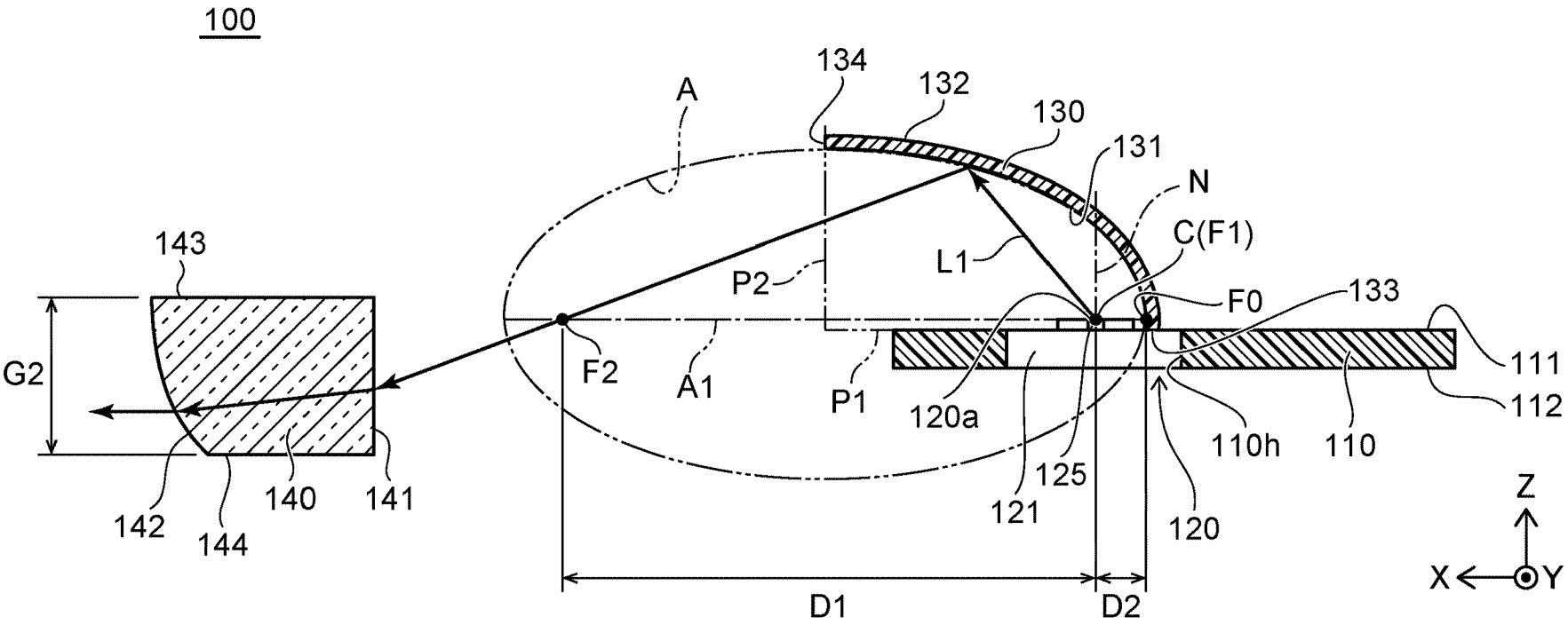
FIG. 2 is a schematic cross-sectional view taken along line II-II in FIG. 1.

FIG. 2 is a schematic cross-sectional view taken along line II-II in FIG. 1.

A lighting device 100 according to the present embodiment is applied to a vehicle lamp, such as a headlamp, for example. The lighting device 100 includes a substrate 110, a light source 120, a reflector 130, and a lens 140, as generally described with reference to FIGS. 1 and 2.

Each component of the lighting device 100 will be described below. In the following description, among outer surfaces of the light source 120, a surface that emits light is referred to as a "light-emitting surface 120*a*." Then, as illustrated in FIG. 2, a direction in which a normal line N extends at a center C of the light-emitting surface 120*a* is referred to as a "first direction Z." Further, a direction orthogonal to the first direction Z is referred to as a "second direction X." Further, a direction orthogonal to the first direction Z and the second direction X is referred to as a "third direction Y." In the following, for ease of explanation, a direction of the first direction Z from the light source 120 toward the reflector 130 is referred to as an "upward direction," and a reverse direction thereof is referred to as a "downward direction"; however, the orientation of the lighting device 100 during use is not limited, and the orientation of the lighting device 100 during use is as desired.

Substrate

Figure 3:
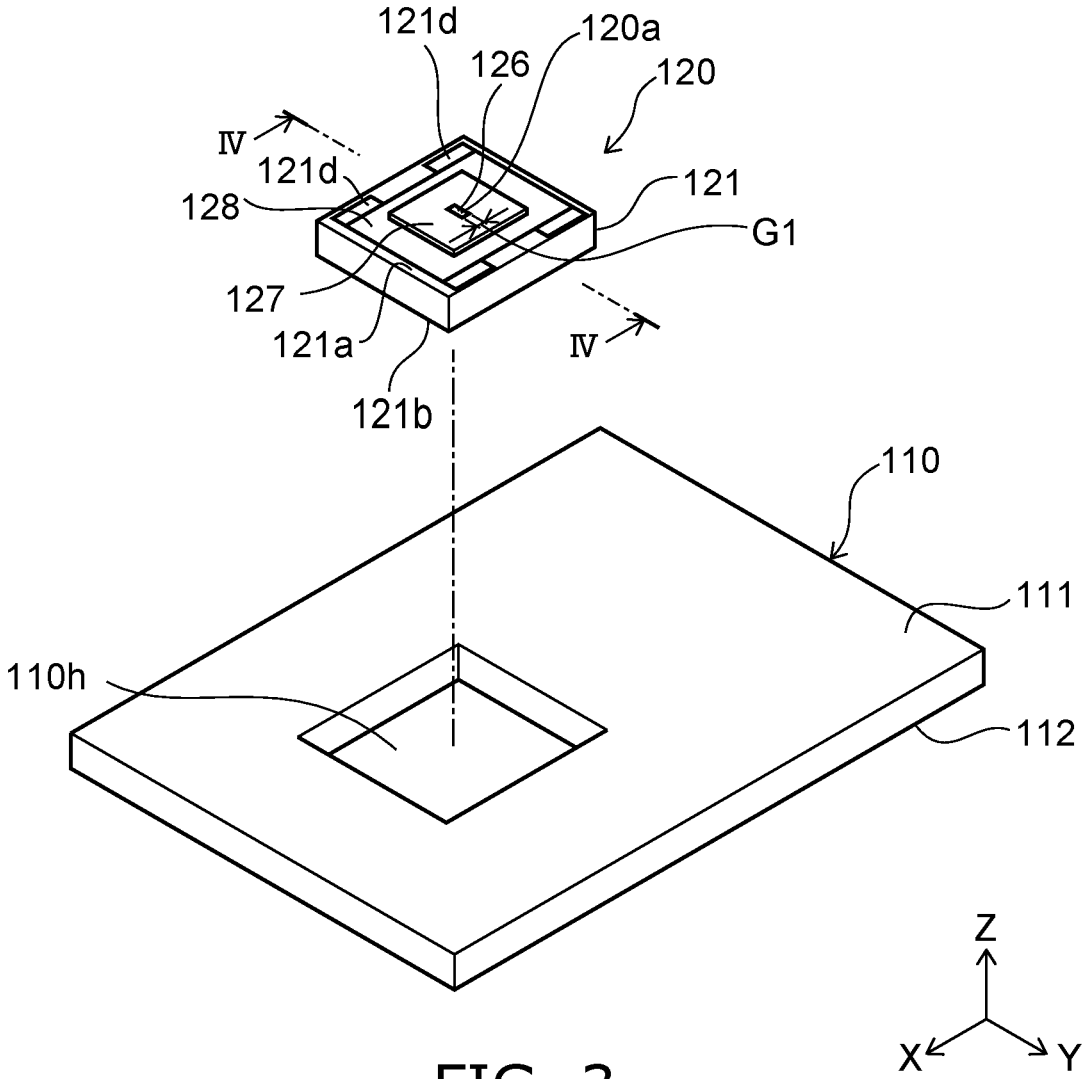
FIG. 3 is a schematic exploded perspective view illustrating a substrate and a light source of the lighting device according to the first embodiment.

FIG. 3 is a schematic exploded perspective view illustrating the substrate and the light source of the lighting device according to the present embodiment.

The light source 120 is mounted on the substrate 110. The substrate 110 is, for example, a wiring substrate including an insulating layer and wiring electrically connected to the light source 120. The substrate 110 is substantially flat in shape in the present embodiment. The substrate 110 has a first surface 111 corresponding to an upper surface, and a second surface 112 located opposite the first surface 111 and corresponding to a lower surface. The first surface 111 and the second surface 112 are substantially flat surfaces and substantially parallel to the second direction X and the third direction Y. However, the shape of the substrate is not limited to the above. For example, the substrate may be curved.

A through hole 110*h* is provided in the substrate 110. The through hole 110*h* passes through the substrate 110 in the first direction Z. A heat dissipation member such as a heat sink, for example, may be disposed below the substrate 110. The lighting device need not include a substrate, and the light source may be held by a holder or the like that includes wiring.

Light Source

The light source 120 emits light toward the reflector 130. The light source 120 is disposed in the through hole 110*h* of the substrate 110 in the present embodiment. However, it is not necessary to provide a through hole in the substrate, and the light source may be disposed on the substrate.

Figure 4:
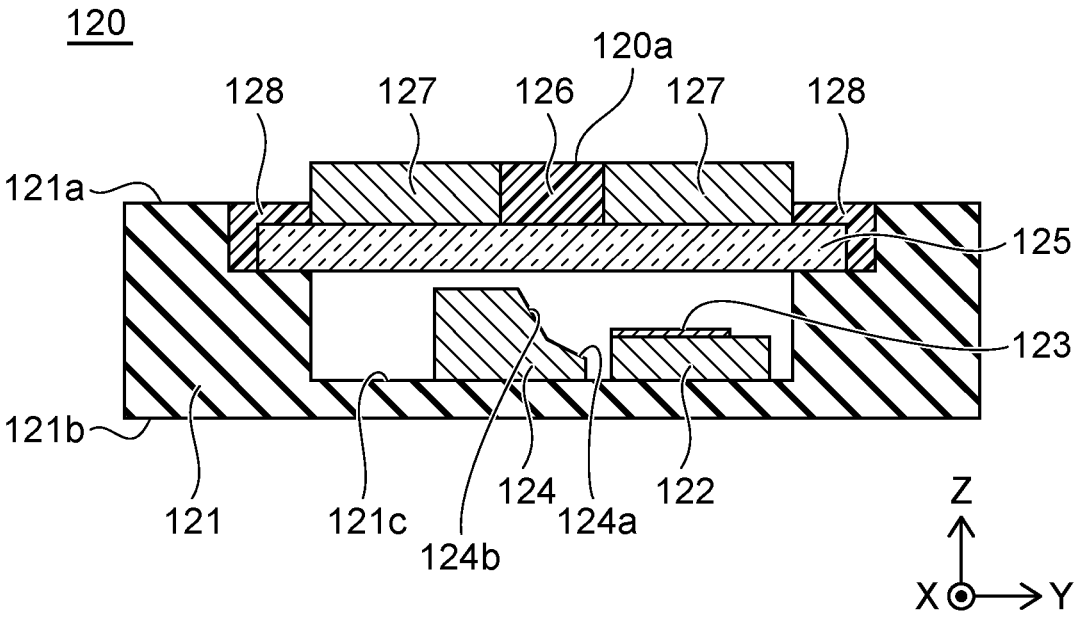
FIG. 4 is a schematic cross-sectional view taken along line IV-IV in FIG. 3.

FIG. 4 is a schematic cross-sectional view taken along line IV-IV in FIG. 3. In the present embodiment, the light source 120 includes a base 121, a sub-mount 122, a light-emitting element 123, a reflective member 124, a light-transmissive member 125, a wavelength conversion member 126, a first light-blocking member 127, and a second light-blocking member 128.

The base 121 has a first surface 121*a* corresponding to an upper surface, and a second surface 121*b* located opposite the first surface 121*a* and corresponding to a lower surface. In the present embodiment, the first surface 121*a* and the second surface 121*b* are substantially flat surfaces and substantially parallel to the second direction X and the third direction Y. In the present embodiment, a recessed portion 121*c* recessed toward the second surface 121*b* is provided in the first surface 121*a*. The sub-mount 122, the light-emitting element 123, and the reflective member 124 are disposed in the recessed portion 121*c*.

As illustrated in FIG. 3, a plurality of wiring members 121*d* are provided on the base 121. Each of the wiring members 121*d* is electrically connected to the light-emitting element 123, a thermistor (not illustrated), or the like disposed in the recessed portion 121*c* of the base 121. Each of the wiring members 121*d* is electrically connected to the wiring of the substrate 110 by wire bonding or the like.

As illustrated in FIG. 4, the sub-mount 122 is disposed on a bottom surface of the recessed portion 121*c*.

The light-emitting element 123 is a laser diode (LD) in the present embodiment. The light-emitting element 123 is disposed on the sub-mount 122. A peak wavelength of the light emitted by the light-emitting element 123 is, for example, in a range of 320 nm to 530 nm. Examples of such a laser diode include materials including a nitride semiconductor, such as GaN, InGaN, or AlGaN. The light-emitting element 123 emits light in a direction intersecting the first direction Z.

The reflective member 124 is disposed on the bottom surface of the recessed portion 121*c* so as to face the light-emitting element 123. The reflective member 124 reflects light in the upward direction. The surface of the reflective member 124 facing the light-emitting element 123 has a first reflective region 124*a* and a second reflective region 124*b*.

The first reflective region 124*a* is inclined with respect to the first direction Z and increases in distance from the light-emitting element 123 in the upward direction. The second reflective region 124*b* is in contact with an upper end of the first reflective region 124*a*. The second reflective region 124*b* is inclined with respect to the first direction Z and increases in distance from the light-emitting element 123 in the upward direction. An angle formed by the second reflective region 124*b* and the first direction Z is smaller than an angle formed by the first reflective region 124*a* and the first direction Z in the present embodiment.

The reflective member 124 is primarily composed of a glass or metal material, for example, and a reflective film such as a metal film or a dielectric multilayer film is provided on the first reflective region 124*a* and the second reflective region 124*b*. However, the specific configuration, such as the shape and the material, of the reflective member is not limited to the above.

The light-transmissive member 125 is attached to the base 121 so as to cover the recessed portion 121*c* of the base 121. The light-transmissive member 125 is composed of a light-transmissive material such as sapphire.

The wavelength conversion member 126 is provided on the light-transmissive member 125. The wavelength conversion member 126 converts the wavelength of a portion of the light reflected by the reflective member 124. The wavelength conversion member 126 includes, for example, a phosphor. Examples of the phosphor used in the wavelength conversion member 126 include a YAG phosphor, a LAG phosphor, or an α-SiAlON phosphor.

An upper surface of the wavelength conversion member 126 corresponds to the light-emitting surface 120*a* in the present embodiment. As illustrated in FIG. 3, in the present embodiment, the shape of the light-emitting surface 120*a* in a top view is rectangular with the third direction Y as the longitudinal direction. Accordingly, the center C of the light-emitting surface 120*a* corresponds to an intersection point of the diagonal lines of the rectangle in the present embodiment. In the present embodiment, the light-emitting surface 120*a* is a flat surface and is substantially parallel to the second direction X and the third direction Y. However, the shape of the light-emitting surface is not limited to the shape described above. For example, the light-emitting surface may have a curved surface.

As illustrated in FIG. 4, the first light-blocking member 127 is provided on the light-transmissive member 125 and around the wavelength conversion member 126. The first light-blocking member 127 is composed of aluminum oxide or aluminum nitride, for example.

The second light-blocking member 128 is provided around the first light-blocking member 127 and covers a portion of the light-transmissive member 125 exposed from the wavelength conversion member 126 and the first light-blocking member 127. The second light-blocking member 128 is composed of a resin containing light-scattering particles such as titanium oxide, for example.

As illustrated in FIG. 3, a maximum dimension G1 of the light-emitting surface 120*a* in the second direction X is not particularly limited, but is preferably in a range of 0.2 mm to 1.0 mm.

A luminance of the light source 120 is not particularly limited, but is preferably in a range of 300 cd/mm$^2$ to 2500 cd/mm$^2$. The luminance can be measured by a luminance meter or the like (for example, the Spectroradiometer CS-2000 manufactured by Konica Minolta).

However, the configuration of the light source is not limited to the above. For example, the light source may include a plurality of the light-emitting elements. In this case, the peak wavelength of the light emitted by each light-emitting element may be the same or may be different. For example, the wavelength conversion member may include a plurality of types of phosphors. For example, the light-emitting element may be a light-emitting diode (LED).

Reflector

The reflector 130 reflects light emitted from the light source 120 toward the lens 140, as illustrated in FIG. 2. The reflector 130 is disposed on the substrate 110. The reflector 130 is a concave mirror that opens towards the substrate 110 and the lens 140, for example.

As illustrated in FIGS. 1 and 2, the reflector 130 has a reflective surface 131 facing the light-emitting surface 120*a* of the light source 120, an outer surface 132 located opposite the reflective surface 131, a first end surface 133 located between the reflective surface 131 and the outer surface 132 and facing the substrate 110, and a second end surface 134 located between an end edge of the reflective surface 131 on the lens 140 side in the second direction X and an end edge of the outer surface 132 on the lens 140 side in the second direction X.

The reflective surface 131 is composed of a portion of a spheroidal surface A in the present embodiment, as illustrated in FIG. 2. Here, "the reflective surface 131 is composed of a portion of a spheroidal surface A" means that the reflective surface 131 is considered a portion of the spheroidal surface A at a practical level, such that manufacturing tolerance is acceptable.

The spheroidal surface A is a surface obtained by rotating an ellipse about a major axis A1. The major axis A1 extends substantially in the second direction X. The spheroidal surface A has two focal points F1, F2. The major axis A1 passes through the two focal points F1, F2 and is substantially orthogonal to the normal line N at the center C of the light-emitting surface 120*a*.

The reflective surface 131 in the present embodiment is composed of a portion of the spheroidal surface A, in a region surrounded by a first plane P1 located above the major axis A1 and parallel to the second direction X and the third direction Y, and a second plane P2 located between the two focal points F1, F2 and parallel to the first direction Z and the third direction Y. Accordingly, the reflective surface 131 intersects the major axis A1 at an intersection point F0.

However, the shape of the reflective surface is not limited to the above.

The outer surface 132 is curved in the same manner as the reflective surface 131. The first end surface 133 is a flat surface and substantially parallel to the second direction X and the third direction Y, for example. The first end surface 133 is disposed below the intersection point F0 in the present embodiment. However, the position of the first end surface in the first direction may be the same as the position of the intersection point in the first direction.

The second end surface 134 is a flat surface and substantially parallel to the first direction Z and the third direction Y, for example.

However, the specific shapes of the outer surface, the first end surface, and the second end surface are not limited to the above.

Hereinafter, of the two focal points F1, F2, the focal point F1 located inside the reflector 130 is referred to as a "first focal point F1." Of the two focal points F1, F2, the focal point F2 located outside the reflector 130 is referred to as a "second focal point F2."

The reflector 130 is disposed so that the position of the first focal point F1 substantially coincides with the position of the center C of the light-emitting surface 120*a* of the light source 120, and the second focal point F2 is located between the reflective surface 131 and the lens 140. Accordingly, the light emitted from the center C of the light-emitting surface 120*a* is reflected by the reflective surface 131, and, after being substantially focused on the second focal point F2, is incident on the lens 140. However, the first focal point F1 need not be located on the center C, and may at least be located on the light-emitting surface 120*a*.

Hereinafter, a distance between the first focal point F1 and the second focal point F2 is referred to as a "first distance D1." A distance between the first focal point F1 and the intersection point F0 is referred to as a "second distance D2." In the present embodiment, a value obtained by dividing the first distance D1 by the second distance D2 is 7 or greater. That is, $D1/D2 \geq 7$. The maximum value obtained by dividing the first distance D1 by the second distance D2 is not particularly limited, but is preferably 30 or less. That is, $D1/D2 \leq 30$ is preferable.

The first distance D1 is not particularly limited, but is preferably in a range of 14 mm to 70 mm. The second distance D2 is not particularly limited, but is preferably in a range of 2 mm to 10 mm.

The reflector 130 is primarily composed of a resin material, and the reflective surface 131 is provided with a reflective film such as a metal film or a dielectric multilayer film. However, the reflector may also be composed of a metal material.

Lens

The lens 140 is, for example, a convex lens. The lens 140 is composed of a light-transmitting material. The lens 140 is disposed separated from the substrate 110 in the X direction.

A front surface of the lens 140 includes an incident surface 141 on which light reflected by the reflective surface 131 is incident, an emission surface 142 located opposite the incident surface 141 and configured to emit light that has entered the lens 140 from the incident surface 141, a first flat surface 143 located between the incident surface 141 and the emission surface 142, and a second flat surface 144 located between the incident surface 141 and the exit surface 142 and on a side opposite to the first flat surface 143.

The incident surface 141 is a flat surface and substantially parallel to the first direction Z and the third direction Y, for example. The exit surface 142 is a convex curved surface, for example.

The first flat surface 143 and the second flat surface 144 are substantially parallel to the second direction X and the third direction Y, for example. The first flat surface 143 corresponds to an upper surface and the second flat surface 144 corresponds to a lower surface. The first flat surface 143 is located above the first surface 111 of the substrate 110. The second flat surface 144 is located below the second surface 112 of the substrate 110.

However, the specific shape of the lens is not limited to the above. For example, the upper surface and lower surface of the lens may be curved surfaces rather than flat surfaces. From the viewpoint of suppressing light being incident on the first flat surface 143 and the second flat surface 144, or suppressing light exiting from the first flat surface 143 and the second flat surface 144, the first flat surface 143 and the second flat surface 144 may be covered by a light-blocking member. This may suppress the occurrence of stray light.

A maximum dimension G2 of the lens 140 in the first direction Z is 20 mm or less. This may reduce the size of the lens 140 in the first direction Z. In a case in which the lighting device 100 is applied to a vehicle lamp, such as a headlamp, the lighting device 100 is mounted on a vehicle with the lens 140 visible from the exterior of the vehicle. In the field of vehicle lamps, a lens having a dimension in the first direction Z of 20 mm or less is preferable from the viewpoint of having a high degree of freedom in design in both design and function due to a small size. Therefore, by using the lighting device 100 provided with such a lens 140 in a vehicle lamp, it is possible to realize a vehicle having good design and/or functionality.

The maximum dimension G2 of the lens 140 in the first direction Z is not particularly limited, but is preferably 3 mm or greater.

The position of the focal point of the lens 140, in the present embodiment, substantially coincides with the position of the second focal point F2 of the reflective surface 131. However, the position of the focal point of the lens may deviate from the position of the second focal point of the reflective surface.

Next, operation of the lighting device 100 according to the present embodiment will be described.

A major portion of light L1 emitted from the center C of the light-emitting surface 120*a* is reflected by the reflective surface 131. A major portion of the light L1 reflected by the reflective surface 131 is incident on the lens 140. In a case in which the lighting device 100 is applied to a headlamp, the light L1 emitted from the lens 140 can be used as a high beam or a low beam. When the light L1 emitted from the lens 140 is used as a low beam, a light-blocking member for forming a cutoff line may be disposed between the lens 140 and the reflector 130. In this case, the light-blocking member may be disposed on the second focal point F2.

Figure 5A:
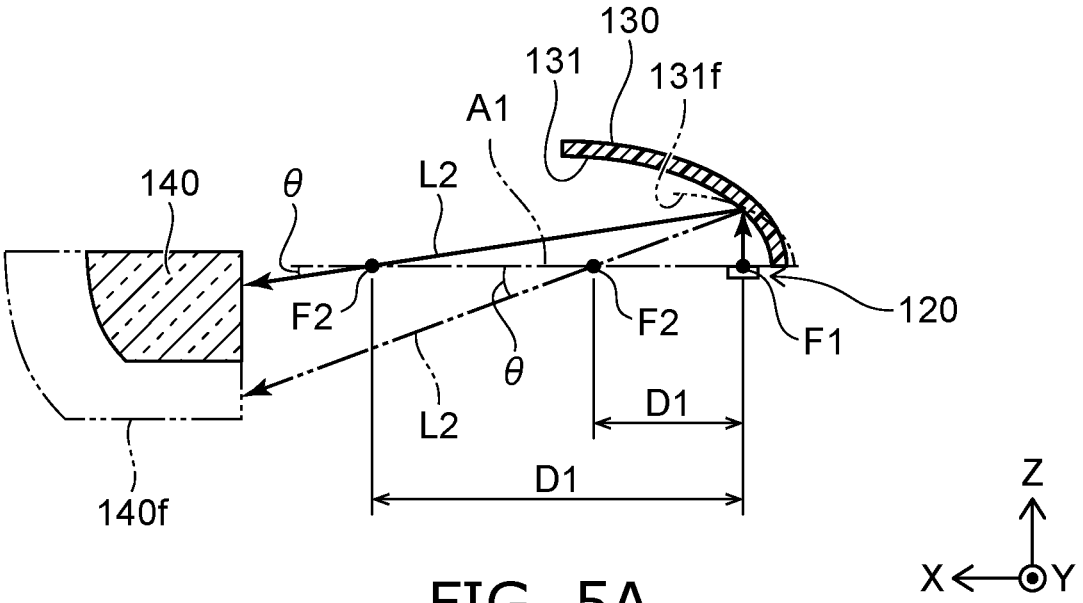
FIG. 5A is a schematic cross-sectional view illustrating paths of light emitted from the light source and reflected by a reflective surface in the first embodiment and by a reflective surface in a reference example.

FIG. 5A is a schematic cross-sectional view illustrating paths of light emitted from the light source and reflected by a reflective surface in the present embodiment and by a reflective surface in a reference example.

In FIG. 5A, a reflective surface 131*f* and light L2 reflected by the reflective surface 131*f* of the reference example are indicated by a two-dot chain line. In FIG. 5A, a lens 140*f* required for the reflective surface 131*f* in the reference example is indicated by a two-dot chain line. In FIG. 5A, the light L2 reflected by the reflective surface 131 in the present embodiment is indicated by a solid line.

The reflective surface 131*f* in the reference example is a reflective surface in which the position of the first focal point F1 is the same as the position of the first focal position F1 of the reflective surface 131 in the present embodiment, and the first distance D1 is shorter than the first distance D1 in the present embodiment.

As illustrated in FIG. 5A, in a case in which the light L2 emitted from the light source 120 in one direction is reflected by the reflective surface 131 in the present embodiment, an angle θ formed by a center axis of the reflected light L2 and the major axis A1 is smaller than an angle θ formed by a center axis of the light L2 reflected by the reflective surface 131*f* and the major axis A1 in the reference example. That is, the longer the first distance D1, the smaller the angle θ formed by the center axis of the light L2 reflected by the reflective surface 131 and the major axis A1. Then, the smaller the angle θ formed by the center axis of the light L2 and the major axis A1, the closer the position of the light L2 in the first direction Z to the position of the major axis A1 in the first direction Z when the light L2 is incident on the lens 140. Accordingly, the longer the first distance D1, the smaller the dimension of the lens 140 in the first direction Z can be without changing the amount of light entering into the lens 140.

Figure 5B:
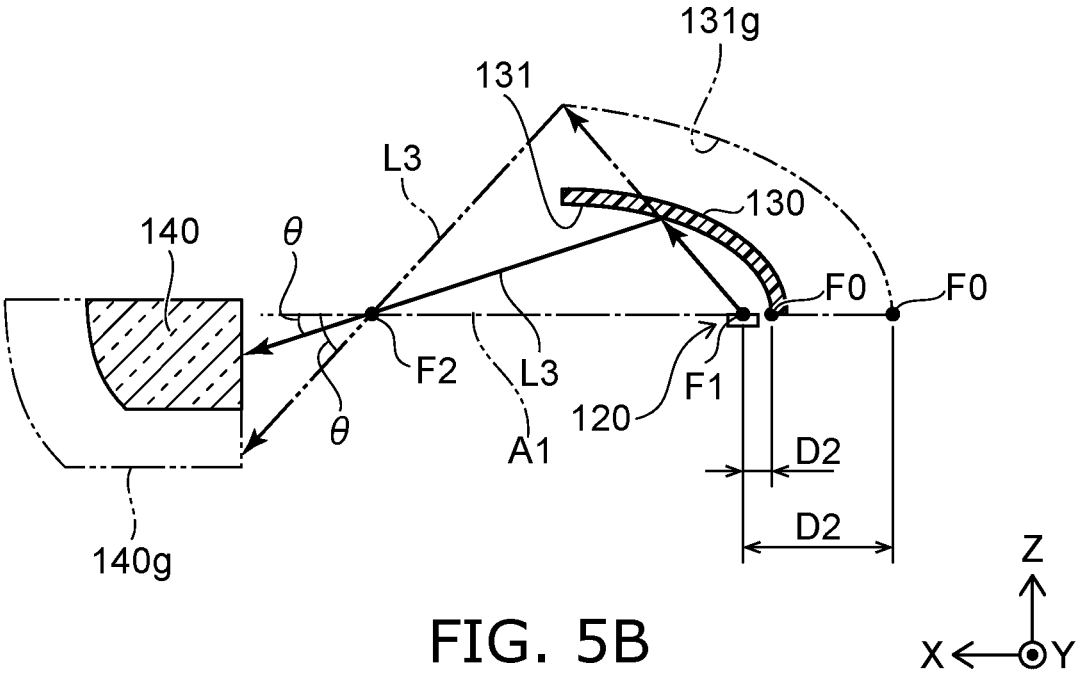
FIG. 5B is a schematic cross-sectional view illustrating paths of light emitted from the light source and reflected by the reflective surface in the first embodiment and by the reflective surface in the reference example.

FIG. 5B is a schematic cross-sectional view illustrating paths of light emitted from the light source and reflected by the reflective surface in the present embodiment and by a reflective surface in a reference example.

Similarly, in FIG. 5B, a reflective surface 131*g* and light L3 reflected by the reflective surface 131*g* of the reference example are indicated by a two-dot chain line. In FIG. 5B, a lens 140*g* required for the reflective surface 131*g* in the reference example is indicated by a two-dot chain line. In FIG. 5B, the light L3 reflected by the reflective surface 131 in the present embodiment is indicated by a solid line.

The reflective surface 131*g* in the reference example is a reflective surface in which the positions of the first focal point F1 and the second focal point F2 are the same as the positions of the first focal point F1 and the second focal point F2 of the reflective surface 131 in the present embodiment, and the second distance D2 is longer than the second distance D2 in the present embodiment.

As illustrated in FIG. 5B, in a case in which the light L3 emitted from the light source 120 in one direction is reflected by the reflective surface 131 in the present embodiment, an angle θ formed by a center axis of the light L3 after reflection and the major axis A1 is smaller than an angle θ formed by a center axis of the light L3 reflected by the reflective surface 131*g* and the major axis A1 in the reference example. That is, the shorter the second distance D2, the smaller the angle θ formed by the center axis of the light L3 reflected by the reflective surface 131 and the major axis A1. Then, the smaller the angle θ formed by the center axis of the light L3 and the major axis A1, the closer the position of the light L3 in the first direction Z to the position of the major axis A1 in the first direction Z when the light L3 is incident on the lens 140. Accordingly, the shorter the second distance D2, the smaller the dimension of the lens 140 in the first direction Z without changing the amount of light entering into the lens 140.

As described above, it is understood that, in order to reduce the dimension of the lens 140 in the first direction Z, it is preferable to lengthen the first distance D1 and shorten the second distance D2. In the present embodiment, a value obtained by dividing the first distance D1 by the second distance D2 is 7 or greater. That is, $D1/D2 \geq 7$. Therefore, the dimension of the lens 140 in the first direction Z can be shortened without changing the amount of light entering into the lens 140. As a result, the lens 140 having a dimension in the first direction Z of 20 mm or less can be realized.

Figure 6A:
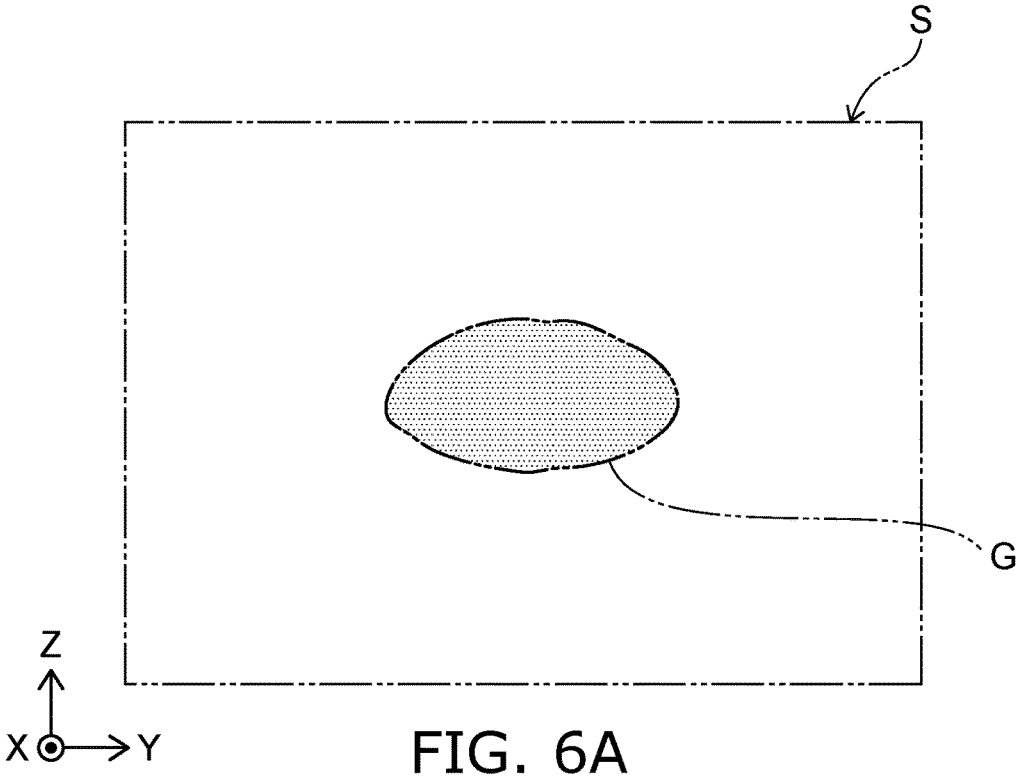
FIG. 6A is a schematic view illustrating an irradiation region of light on a screen in a case in which a screen is provided at a second focal point of the reflective surface in the reference example.

FIG. 6A is a schematic view illustrating an irradiation region of light on a screen in a case in which a screen is provided at the second focal point of the reflective surface in the reference example.

Figure 6B:
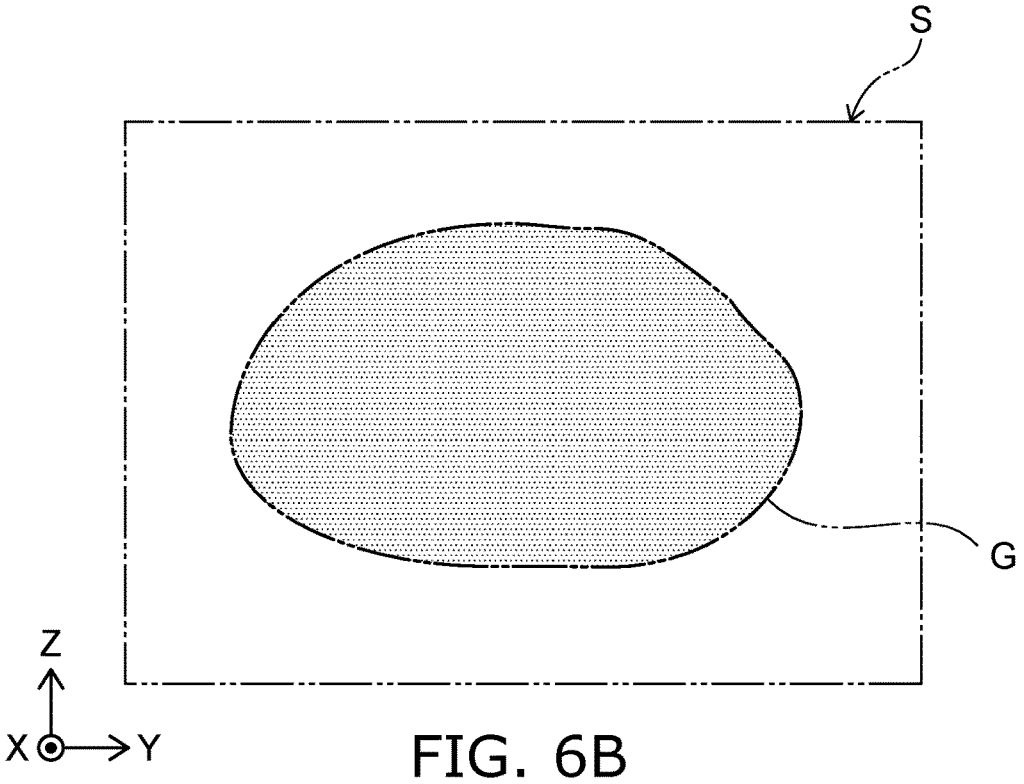
FIG. 6B is a schematic view illustrating an irradiation region of light on a screen in a case in which a screen is provided at a second focal point of the reflective surface in the first embodiment.

FIG. 6B is a schematic view illustrating an irradiation region of light on a screen in a case in which a screen is provided at the second focal point of the reflective surface in the present embodiment.

The light source 120 includes the light-emitting surface 120*a* rather than a point light source. Therefore, in a case in which a screen S is disposed on the second focal point F2 of the reflective surface 131, the light emitted from the light-emitting surface 120*a* is not completely focused at the second focal point F2, and is emitted to an irradiation region G spreading in the first direction Z and the third direction Y on the screen S.

Then, as illustrated in FIG. 5A, for example, the longer the first distance D1, the longer the distance until the light L2 reflected by the reflective surface 131 reaches the screen S. As the distance until the light L2 reaches the screen S increases, the light L2 spreads, and thus the surface area of the irradiation region G on the screen S increases, as illustrated in FIGS. 6A and 6B. The larger the surface area of the irradiation region G on the screen S, the lower the maximum illuminance in the irradiation region G. The position of the second focal point F2 substantially coincides with the focal position of the lens 140. Accordingly, placement of a light source realizing an illuminance distribution such as the irradiation region G at the focal point of the lens 140 can be considered. As such, it is understood that the maximum illuminance in the irradiation region G at the second focal point F2 decreases, and thus the maximum illuminance in the irradiation region of light emitted from the lens 140 also decreases. That is, the longer the first distance D1, the lower the maximum illuminance in the irradiation region of the light emitted from the lens 140.

For example, as illustrated in FIG. 5B, the shorter the second distance D2, the less likely that the reflective surface 131 focuses the light emitted from the light-emitting surface 120*a* of the light source 120. Accordingly, the shorter the second distance D2, the larger the surface area of the irradiation region G on the screen S. The larger the surface area of the irradiation region G on the screen S, the lower the maximum illuminance in the irradiation region G. Accordingly, the shorter the second distance D2, the lower the maximum illuminance in the irradiation region of the light emitted from the lens 140. Such an irradiation region G can be similarly exhibited as in the case shown in FIG. 6A and 6B that illustrate the change of irradiation region attributed to the above-described length of the first distance D1.

As described above, as the value of D1/D2 increases, the maximum illuminance in the irradiation region of the light emitted from the lens 140 decreases. In contrast, in the present embodiment, the luminance of the light source 120 is 300 cd/mm$^2$ or greater. Therefore, by setting the value of D1/D2 to 7 or greater, it is possible to compensate for a decrease in the maximum illuminance in the irradiation region of the light emitted from the lens 140 by improving the luminance of the light source 120.

The longer the distance to the lens 140, the easier it is for the light reflected at the reflective surface 131 and focused at the second focal point F2 to spread out before being incident on the lens 140. Accordingly, the shorter the distance between the lens 140 and the second focal point F2 in the second direction X, the smaller the dimension of the lens 140 in the first direction Z. On the other hand, the shorter the focal length of the lens 140 to bring the lens 140 closer to the second focal point F2, the wider the irradiation region of the light emitted from the lens 140, and the lower the maximum illuminance in the irradiation region. From the above, from the viewpoint of suppressing an excessive reduction in maximum illuminance in the irradiation region while reducing the lens 140 in size in the first direction Z, the distance between the incident surface 141 of the lens 140 and the second focal point F2 (light-blocking member for forming a cutoff line in a case in which the light-blocking member is provided to the lighting device 100) in the second direction X is preferably in a range of 10 mm to 25 mm.

Next, an effect of the present embodiment will be described.

The lighting device 100 according to the present embodiment includes the light source 120 having the light-emitting surface 120*a*, the reflector 130 having the reflective surface 131 configured to reflect light emitted from the light source 120, and the lens 140 on which light reflected by the reflective surface 131 is incident. The reflective surface 131 is composed of a portion of the spheroidal surface A including the first focal point F1 located above the light-emitting surface 120*a* and the second focal point F2 located between the reflective surface 131 and the lens 140. The reflective surface 131 intersects the major axis A1 of the spheroidal surface A. The value obtained by dividing the first distance D1 between the first focal point F1 and the second focal point F2 by the second distance D2 between the first focal point F1 and the intersection point F0 of the reflective surface 131 and the major axis A1 is 7 or greater. The maximum dimension of the lens 140 in the first direction Z in which the normal line N extends at the center C of the light-emitting surface 120*a* is 20 mm or less. As a result, it is possible to realize the lens 140 in which the dimension of the lens 140 in the first direction Z is shortened without changing the amount of light entering into the lens 140. For example, in a case in which the lighting device 100 is applied to a vehicle lamp such as a headlamp, the dimension of the lens 140 in the first direction Z is shortened, making it possible to realize a vehicle with improved freedom in design and good design and/or functionality.

The first distance D1 is preferably 14 mm or greater, and more preferably 21 mm or greater. In the present embodiment, the second distance D2 is preferably 10 mm or less, and more preferably 3 mm or less. The value of D1/D2 can be increased when the first distance D1 is 21 mm or greater, or the second distance D2 is 3 mm or less.

The first distance D1 is preferably 70 mm or less. As a result, it is possible to suppress an excessive reduction in the maximum illuminance in the irradiation region of the light emitted from the lens 140.

The second distance D2 is preferably 2 mm or greater. As a result, it is possible to suppress an excessive reduction in the maximum illuminance in the irradiation region of the light emitted from the lens 140. As a result, the light source 120 and the reflective surface 131 can be separated to the extent that a reflective film constituting the reflective surface 131 does not peel or become damaged due to heat generated in the light source 120. As illustrated in FIG. 5B, the shorter the second distance D2, the smaller the size of the reflector 130, and the higher the positional accuracy required when arranging the relative positions of the light source 120, the reflector 130, and the lens 140. With the second distance D2 set to 2 mm or greater, it is possible to suppress an excessive increase in the positional accuracy required.

The maximum dimension G1 of the light-emitting surface 120*a* in the second direction X in which the major axis A1 extends is preferably 1.0 mm or less. This makes it easier to shorten the first distance D1. The maximum dimension G1 of the light-emitting surface 120*a* in the second direction X is preferably 0.2 mm or greater. As a result, the maximum dimension of the light-emitting surface 120*a* in the second direction X can be sufficiently greater than an adjustment accuracy of the position of the light source 120 in the second direction X. Therefore, even if the position of the light-emitting surface 120*a* deviates from the design position in the second direction X, it is possible to suppress a reduction in the maximum illuminance in the irradiation region of the light emitted from the lens 140.

The luminance of the light source 120 is preferably 300 cd/mm$^2$ or greater. Thus, by setting the value of D1/D2 to 7 or greater, it is possible to compensate for a decrease in the maximum illuminance in the irradiation region of the light emitted from the lens 140 by improving the luminance of the light source 120. In particular, by using a laser diode as the light-emitting element 123 of the light source 120, the luminance of the light source 120 can be improved more easily.

The lens 140 has the incident surface 141 on which light reflected by the reflective surface 131 is incident, the emission surface 142 located opposite the incident surface 141 and configured to emit light transmitted from the incident surface 141, the first flat surface 143 located between the incident surface 141 and the emission surface 142, and the second flat surface 144 located opposite the first flat surface 143 in the first direction Z and located between the incident surface 141 and the exit surface 142. In this way, the lens 140 includes the first flat surface 143 and the second flat surface 144, and therefore the dimension of the lens 140 in the first direction Z can be reduced in comparison to a case in which the upper surface of the lens is convex in the upward direction or the lower surface of the lens is convex in the downward direction.

The value of D1/D2 is preferably 30 or less. As a result, it is possible to suppress an excessive reduction in the maximum illuminance in the irradiation region of the light emitted from the lens 140.

Second Embodiment

Next, a second embodiment will be described.

Figure 7:
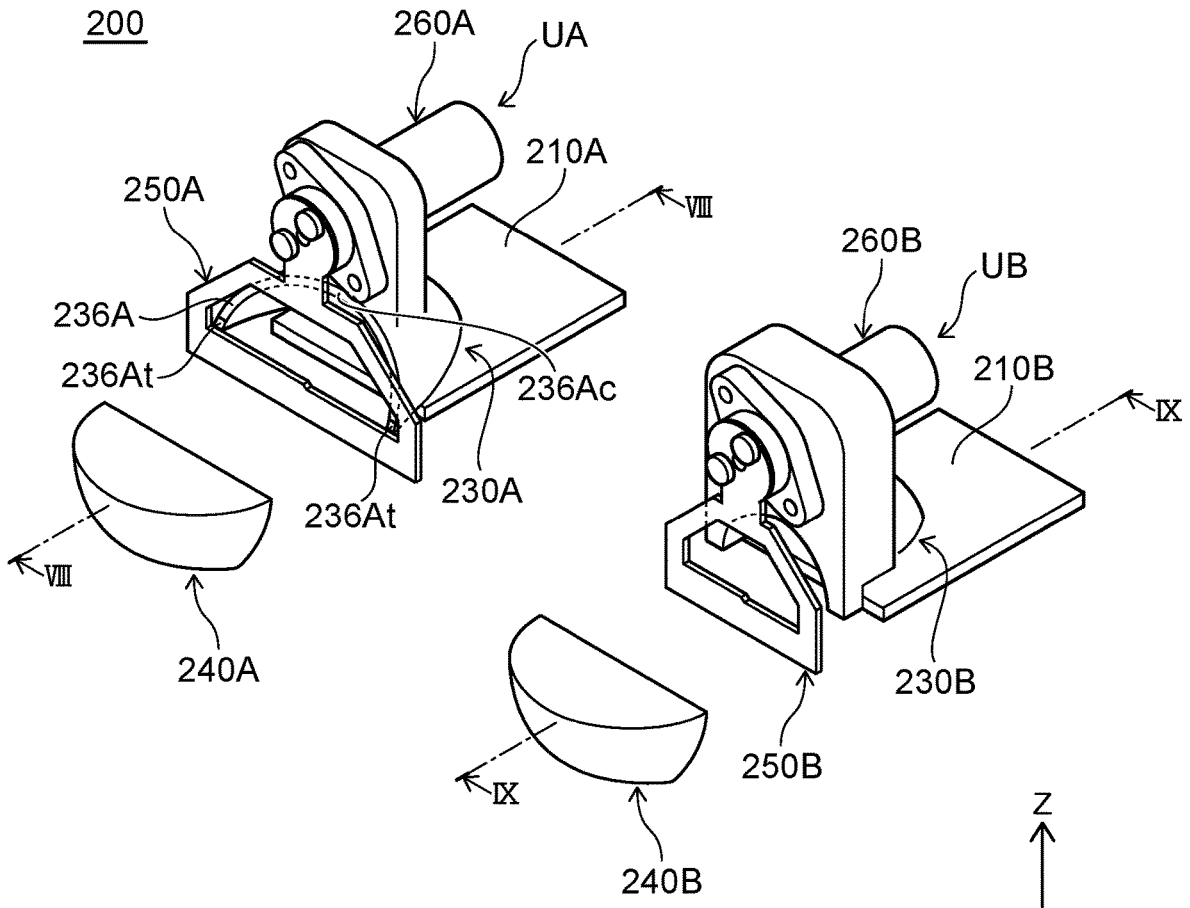
FIG. 7 is a schematic perspective view illustrating a lighting device according to a second embodiment.

FIG. 7 is a schematic perspective view illustrating a lighting device according to the present embodiment.

Figure 8:
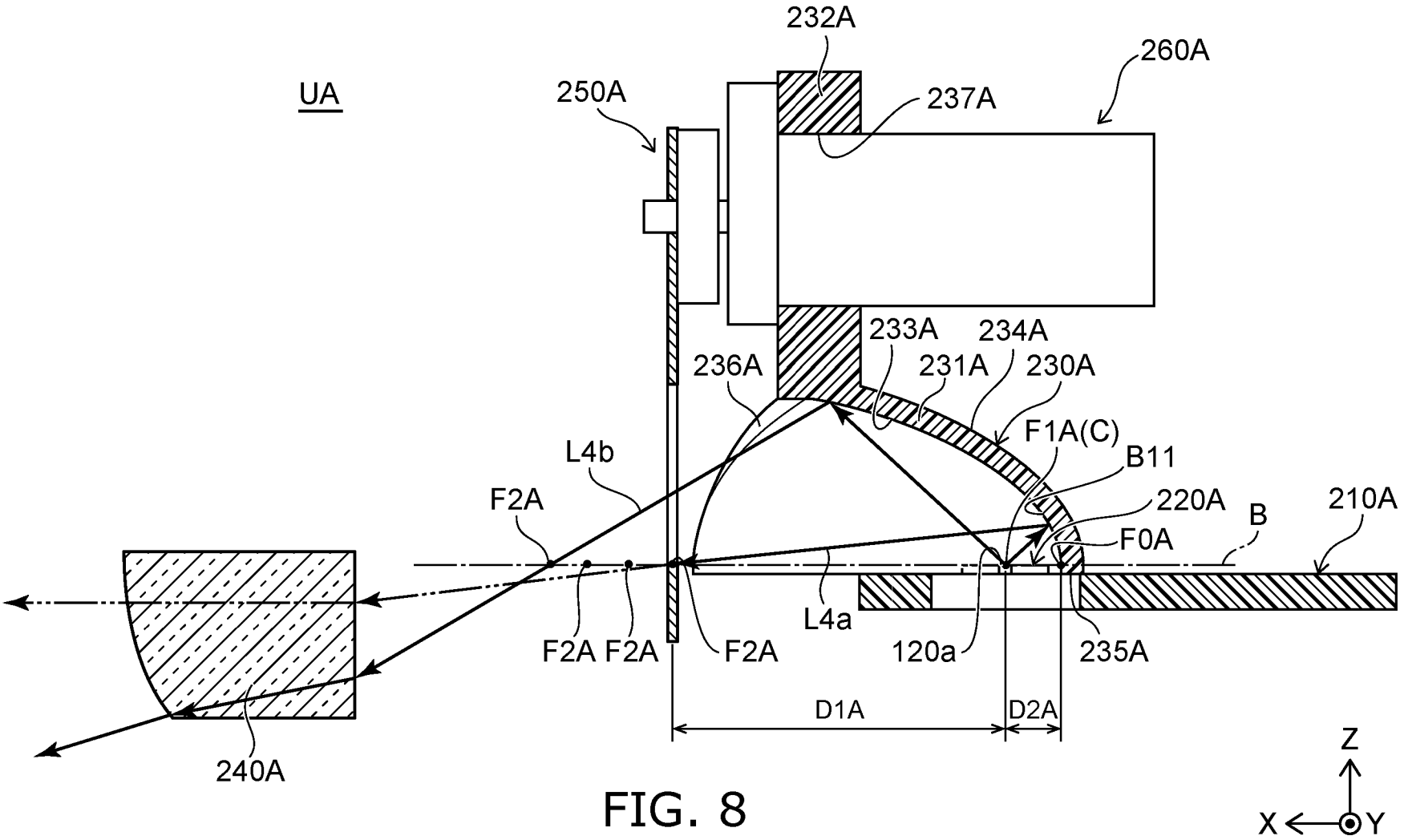
FIG. 8 is a schematic cross-sectional view taken along line VIII-VIII in FIG. 7.

FIG. 8 is a schematic cross-sectional view taken along line VIII-VIII in FIG. 7.

Figure 9:
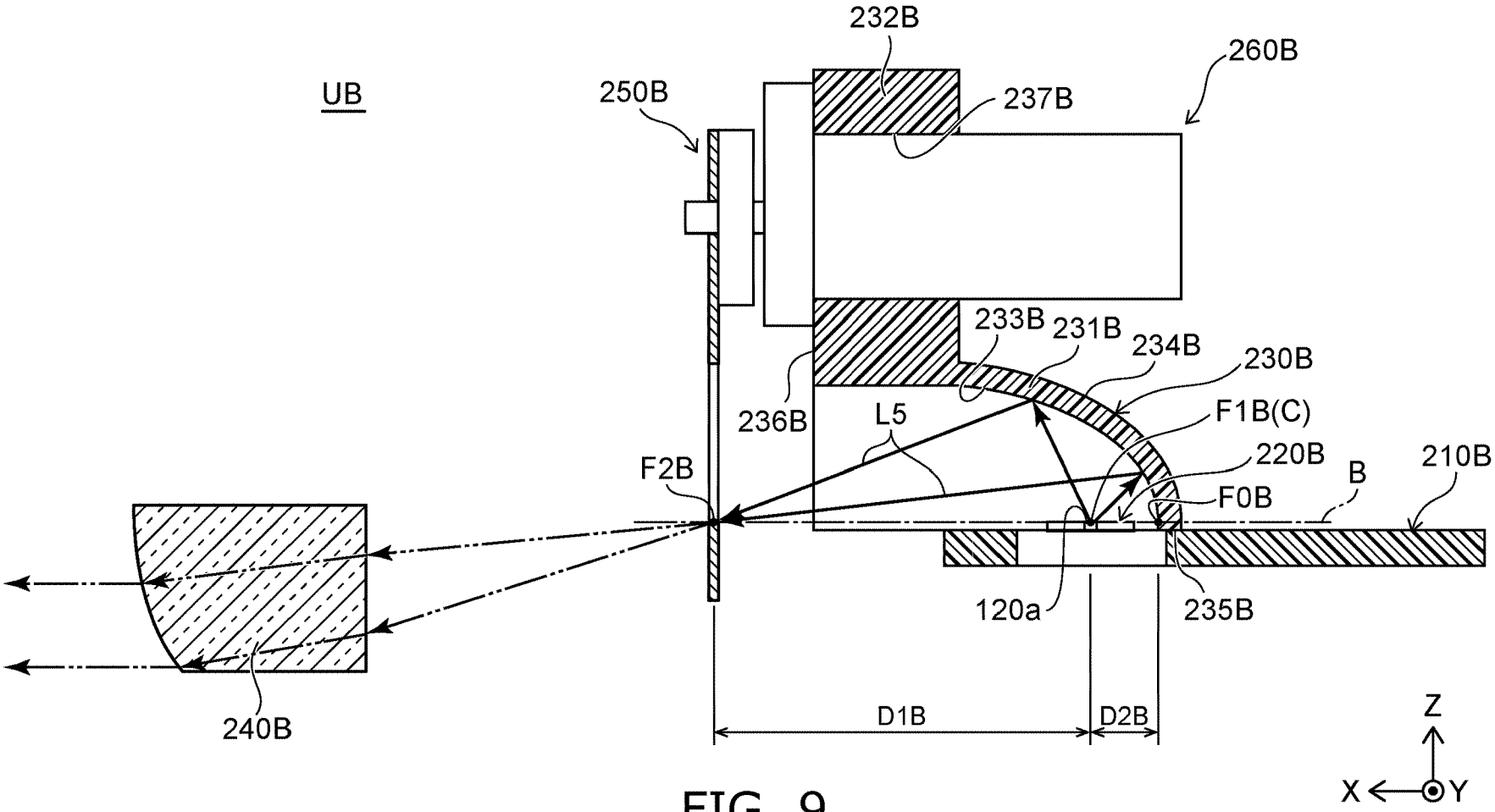
FIG. 9 is a schematic cross-sectional view taken along line IX-IX in FIG. 7.

FIG. 9 is a schematic cross-sectional view taken along line IX-IX in FIG. 7.

A lighting device 200 according to the present embodiment includes a first unit UA and a second unit UB. As illustrated in FIG. 8, the first unit UA includes a first substrate 210A, a first light source 220A, a first reflector 230A, a first lens 240A, a first light-blocking member 250A, and a first drive member 260A. As illustrated in FIG. 9, the second unit UB includes a second substrate 210B, a second light source 220B, a second reflector 230B, a second lens 240B, a second light-blocking member 250B, and a second drive member 260B.

The first unit UA functions as a diffusion unit that primarily emits diffused light, and the second unit UB functions as a focusing unit that primarily emits parallel light. Below, each component of the lighting device 200 will be described in detail.

Substrate

The first substrate 210A and the second substrate 210B are each configured similarly to the substrate 110 in the first embodiment, and thus a detailed description thereof will be omitted.

Light Source

The first light source 220A and the second light source 220B are each configured similarly to the light source 120 in the first embodiment, and thus a detailed description thereof will be omitted.

Reflector

First, the first reflector 230A will be described.

As illustrated in FIG. 8, the first reflector 230A includes a main body portion 231A configured to reflect light emitted from the first light source 220A toward the first lens 240A, and an attachment portion 232A to which the first drive member 260A is attached.

The main body portion 231A is disposed on the first substrate 210A. The main body portion 231A is, for example, a concave mirror open toward the first substrate 210A and the first lens 240A.

A front surface of the main body portion 231A includes a reflective surface 233A facing the light-emitting surface 120*a* of the first light source 220A and curved in a concave shape, an outer surface 234A located opposite the reflective surface 233A, a first end surface 235A located between the reflective surface 233A and the outer surface 234A and facing the first substrate 210A, and a second end surface 236A located between an end edge of the reflective surface 233A on the first lens 240A side in the second direction X and an end edge of the outer surface 234A on the first lens 240A side in the second direction X.

Figure 10A:
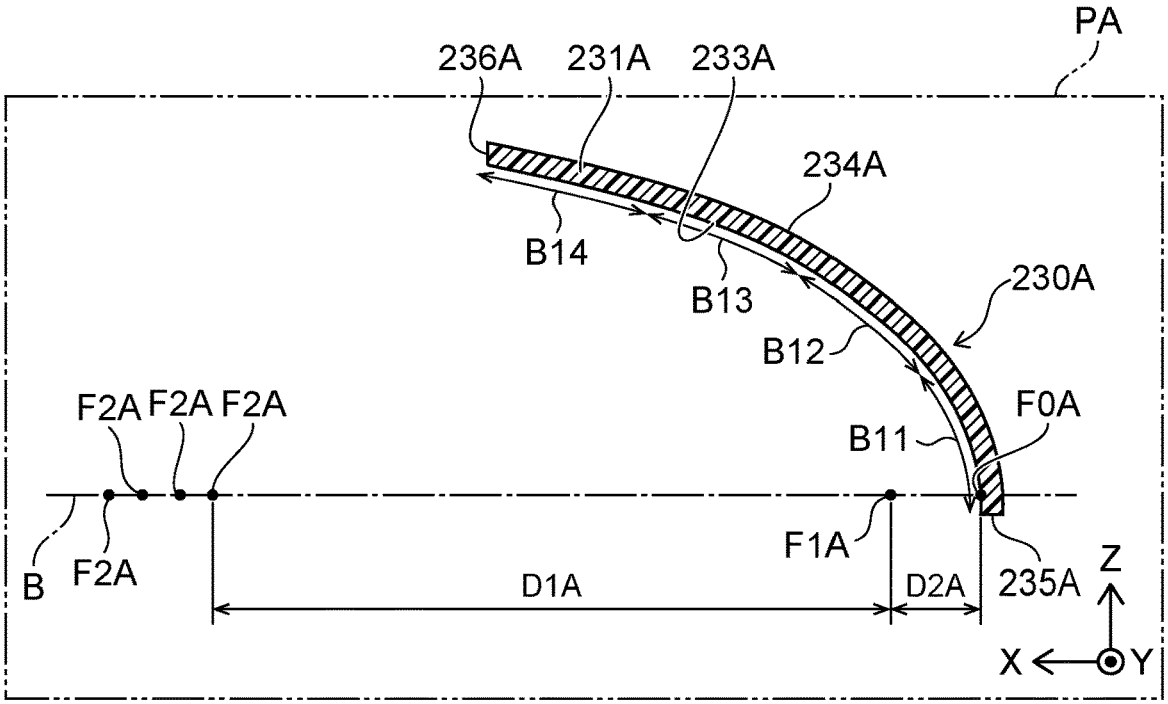
FIG. 10A is a schematic cross-sectional view illustrating a shape of a reflective surface of a first reflector according to the second embodiment.

FIG. 10A is a schematic cross-sectional view illustrating a shape of the reflective surface of the first reflector according to the present embodiment.

Figure 10B:
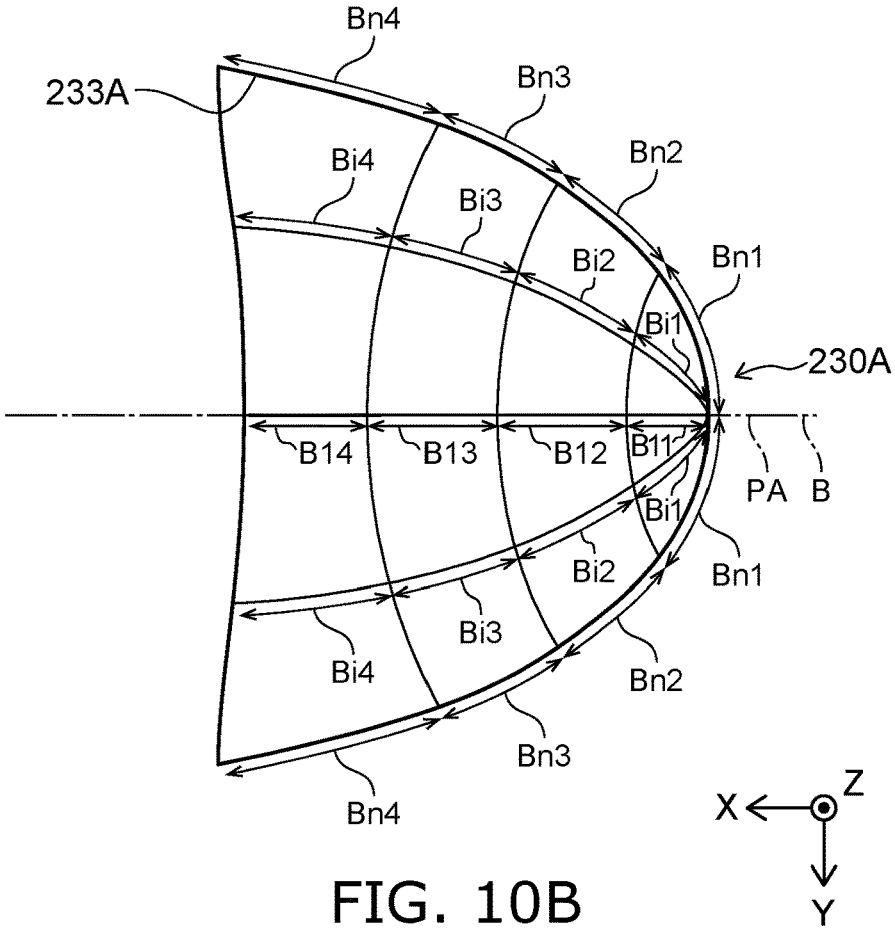
FIG. 10B is a schematic top view illustrating the shape of the reflective surface of the first reflector according to the second embodiment.

FIG. 10B is a schematic top view illustrating the shape of the reflective surface of the first reflector according to the present embodiment.

The reflective surface 233A has a substantially symmetrical shape with respect to a plane PA parallel to the first direction Z and the second direction X, as illustrated in FIG. 10B. Hereinafter, an axis passing through the light-emitting surface and extending in the second direction X is referred to as an "axis B."

The reflective surface 233A has a shape obtained by combining portions B11, B12, B13, B14 of outer peripheries of a plurality of ellipses (hereinafter also referred to as "portions B11, B12, B13, B14") in a cross section including the plane PA, as illustrated in FIG. 10A. Lengths of major axes, lengths of minor axes, and the like of the ellipses constituting the plurality of portions B11, B12, B13, B14 differ from one another. The plurality of portions B11, B12, B13, B14 are arrayed from the first end surface 235A side toward the second end surface 236A side. In a cross-section including the plane PA, the plurality of portions B11, B12, B13, B14 are provided so as to be separated from the axis B from the first end surface 235A side toward the second end surface 236A side.

The major axis of the ellipse constituting, among the four portions B11, B12, B13, B14, the portion B11 closest to the first end surface 235A substantially coincides with the axis B in the present embodiment. The portion B11 reaches a position that intersects the axis B.

Each of the portions B11, B12, B13, B14 has a first focal point F1A and a second focal point F2A. The positions of the first focal points F1A of the plurality of portions B11, B12, B13, B14 substantially coincide. As illustrated in FIG. 8, the position of the first focal point F1A substantially coincides with the position of the center C of the light-emitting surface 120*a* of the first light source 220A. However, the first focal point F1A need not be located on the center C and may be located on the light-emitting surface 120*a*.

The second focal points F2A of the plurality of portions B11, B12, B13, B14, as illustrated in FIG. 10A, are each located substantially on the axis B in the present embodiment, but the positions in the second direction X differ from one another. The length of a major axis, the length of a minor axis, and the like of the ellipse constituting the portion B11 are set so that a distance between the first focal point F1A and the second focal point F2A of the portion B11 closest to the first end surface 235A is shorter than distances between the first focal points F1A and the second focal points F2A of the other portions B12, B13, B14, respectively. However, the positions of the second focal points F2A are not limited to the above. For example, the positions of the plurality of second focal points F2A may differ in the first direction Z.

As illustrated in FIG. 10B, the reflective surface 233A has a shape in which a curvature based on the curvature of each of the portions B11, B12, B13, B14 gradually varies as a distance from the plane PA increases in a circumferential direction with the axis B serving as a center axis so the portions of the outer peripheries of the other plurality of ellipses satisfy the conditions of the ellipse. Accordingly, the reflective surface 233A has a shape obtained by combining portions Bn1, Bn2, Bn3, Bn4 of the outer peripheries of the other plurality of ellipses in a cross section that includes the axis B and is closest to the first substrate 210A. The reflective surface 233A, for example, has a shape obtained by combining portions Bi1, Bi2, Bi3, Bi4 of outer peripheries of other plurality of ellipses in a cross section that includes the axis B and is located between the portions B11 to B14 and the portions Bn1 to Bn4. Then, curvatures of the portions Bi1, Bn1 differ from the curvature of the portion B11. Curvatures of the portions Bi2, Bn2 differ from the curvature of the portion B12. The curvatures of the portions Bi3, Bn3 differ from the curvature of the portion B13. he curvatures of the portions Bi4, Bn4 differ from the curvature of the portion B14. In other words, the reflective surface 233A has a shape obtained by combining portions of the outer peripheries of the plurality of ellipses in any cross section including the axis B. Note that the number of portions of the outer peripheries of the ellipses constituting each cross section of the reflective surface is not limited to four.

In the present embodiment, in the reflective surface 233A, a distance between the first focal point F1A and the second focal point F2A of the portion B11 located in the plane PA and closest to the first end surface 235A is shorter than distances between the first focal points F1A and the second focal points F2A of the other portions B12 to B14, Bi1 to Bi4, and Bn1 to Bn4, respectively. Hereinafter, the ellipse constituting the portion B11 closest to the first end surface 235A is referred to as a "first ellipse." A distance between the first focal point F1A and the second focal point F2A of the first ellipse, that is, the portion B11, is referred to as a "first distance D1A." A distance between the first focal point F1A of the first ellipse and an intersection point F0A of a major axis of the first ellipse (axis B) and the reflective surface 233A is referred to as a "second distance D2A."

In the present embodiment, a value obtained by dividing the first distance D1A by the second distance D2A is 7 or greater. That is, D1A/D2A≥7. A maximum value obtained by dividing the first distance D1A by the second distance D2A is not particularly limited, but is 30 or less. That is, D1A/D2A≤30. A maximum value obtained by dividing the first distance D1A by the second distance D2A is not particularly limited, but is preferably 10 or less. That is, D1A/D2A≤10 is preferable.

The first distance D1A is not particularly limited, but is preferably in a range of 14 mm to 70 mm. The second distance D2A is not particularly limited, but is preferably in a range of 2 mm to 10 mm.

The outer surface 234A is curved in the same manner as the reflective surface 233A.

The first end surface 235A is a flat surface and substantially parallel to the second direction X and the third direction Y, for example. The first end surface 235A is located below the intersection point F0A in the present embodiment. However, the position of the first end surface in the first direction may be the same as the position of the intersection point in the first direction.

As illustrated in FIG. 7, the second end surface 236A is a curved surface in which both ends 236At in the third direction Y are located closer to the first lens 240A side in the second direction X than a center portion 236Ac located substantially in the center of both ends 236At.

However, the specific shapes of the outer surface, the first end surface, and the second end surface are not limited to the above.

The attachment portion 232A protrudes upwardly from the main body portion 231A. A through-hole 237A is provided in the attachment portion 232A. The first drive member 260A is disposed in the through-hole 237A.

The first reflector 230A is primarily composed of a resin material, and the reflective surface 233A is provided with a reflective film such as a metal film or a dielectric multilayer film. However, the first reflector may also be composed of a metal material.

Next, the second reflector 230B will be described.

As illustrated in FIG. 9, the second reflector 230B includes a main body portion 231B configured to reflect light emitted from the second light source 220B toward the second lens 240B, and an attachment portion 232B to which the second drive member 260B is attached.

The main body portion 231B is disposed on the second substrate 210B. The main body portion 231B is, for example, a concave mirror open toward the second substrate 210B and the second lens 240B.

A front surface of the main body portion 231B includes a reflective surface 233B facing the light-emitting surface 120*a* of a second light source 220B and curved in a concave shape, an outer surface 234B located opposite the reflective surface 233B, a first end surface 235B located between the reflective surface 233B and the outer surface 234B and facing the second substrate 210B, and a second end surface 236B located between an end edge of the reflective surface 233B on the second lens 240B side in the second direction X and an end edge of the outer surface 234B on the second lens 240B side in the second direction X.

Figure 11A:
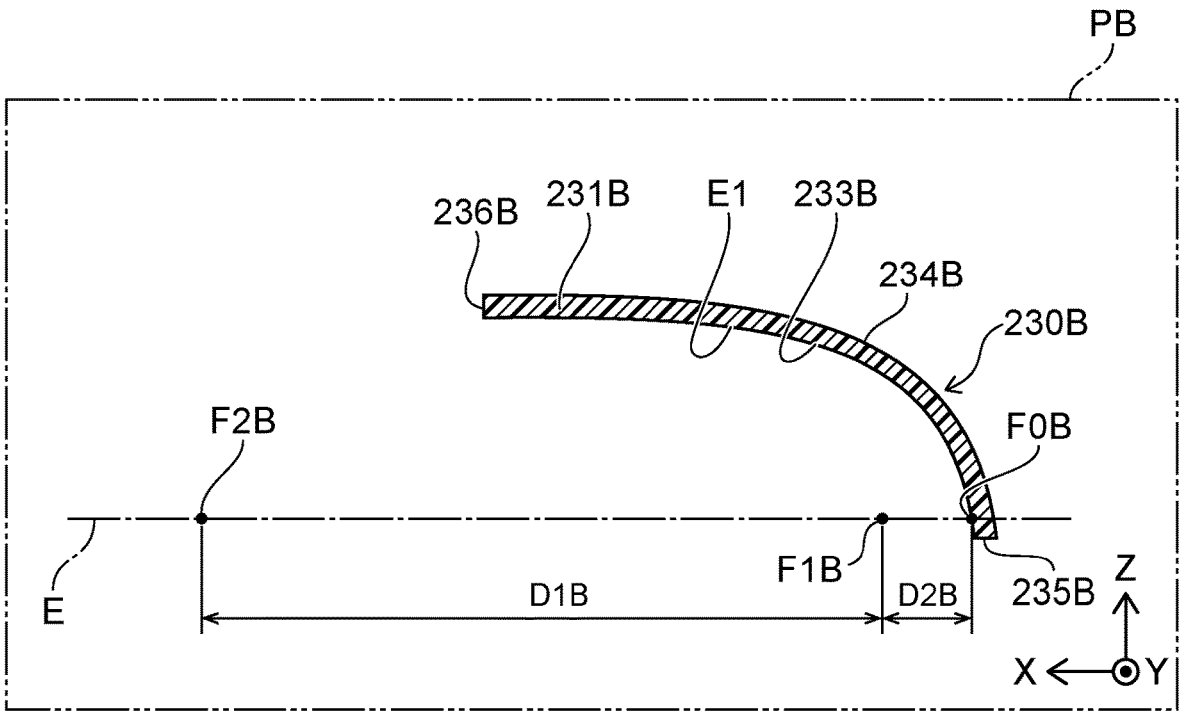
FIG. 11A is a schematic cross-sectional view illustrating a shape of a reflective surface of a second reflector according to the second embodiment.

FIG. 11A is a schematic cross-sectional view illustrating a shape of the reflective surface of the second reflector according to the present embodiment.

Figure 11B:
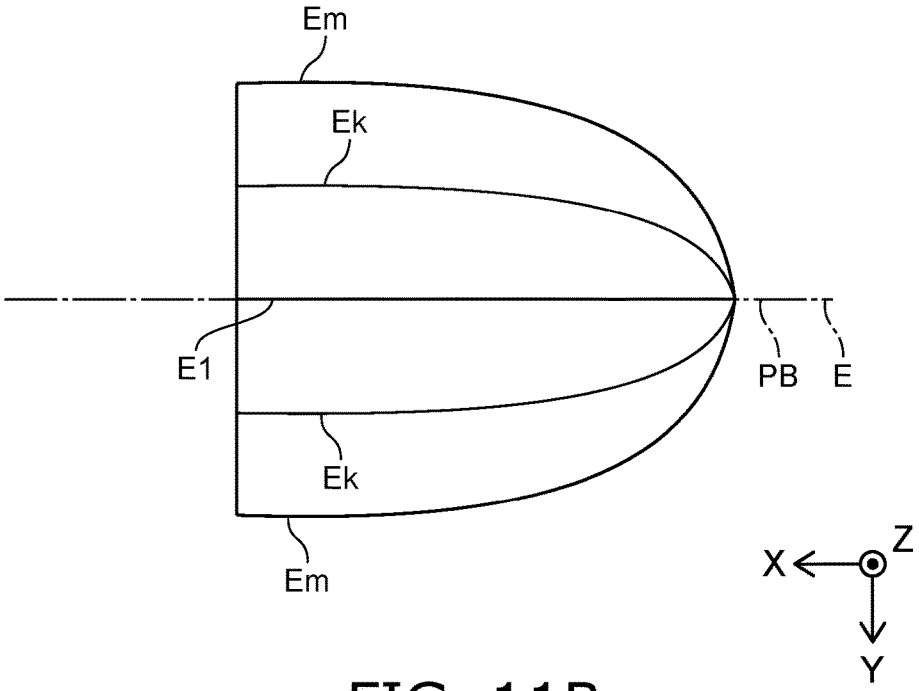
FIG. 11B is a schematic top view illustrating the shape of the reflective surface of the second reflector according to the second embodiment.

FIG. 11B is a schematic top view illustrating the shape of the reflective surface of the second reflector according to the present embodiment.

The reflective surface 233B has a substantially symmetrical shape with respect to a plane PB parallel to the first direction Z and the second direction X, as illustrated in FIG. 11B. Hereinafter, an axis passing through the light-emitting surface and extending in the second direction X is referred to as an "axis E."

The reflective surface 233B, as illustrated in FIG. 11A, is composed of a portion E1 of an outer periphery of one ellipse (hereinafter also referred to as "portion E1") in a cross section including the plane PB. A major axis of the ellipse constituting the portion E1 substantially coincides with the axis E. The portion E1 is curved away from the axis E from the first end surface 235B side toward the second end surface 236B side in a cross section including the plane PB.

As illustrated in FIG. 11B, the reflective surface 233B has a shape in which a curvature based on the curvature of the portion E1 of the outer periphery of one ellipse gradually varies as the distance from the plane PB increases in a circumferential direction with the axis E serving as a center axis so the portions of the outer peripheries of the other plurality of ellipses satisfy the conditions of the ellipse. Accordingly, the reflective surface 233B is composed of a portion Em of an outer periphery of the other ellipse (hereinafter also referred to as "portion Em") that differs in curvature from that of the ellipse constituting the portion E1, in a cross section that includes the axis E and is closest to the second substrate 210B. The reflective surface 233B is composed of a portion Ek of an outer periphery of the other ellipse (hereinafter also referred to as "portion Ek") that differs in curvature from that of the ellipse constituting the portion E1, in a cross section that includes the axis E and is located between the portion E1 and the portion Em. Thus, the reflective surface 233B is composed of portions of outer peripheries of ellipses in any cross section including the axis E. In other words, the reflective surface 233B has a shape obtained by combining the portions E1, Ek, Em of the outer peripheries of the plurality of ellipses in a circumferential direction with the axis E as the center axis.

Each portion E1, Ek, Em constituting the reflective surface 233B includes the first focal point F1B and the second focal point F2B.

Positions of the first focal points F1B of the plurality of portions E1, Ek, Em substantially coincide. As illustrated in FIG. 9, the position of the first focal points F1B substantially coincides with the position of the center C of the light-emitting surface 120*a* of the second light source 220B. However, the first focal points F1B need not necessarily be located on the center C and may be located on the light-emitting surface 120*a*.

Positions of the second focal points F2B of the plurality of portions E1, Ek, Em are considered to be close and substantially coincide, as illustrated in FIG. 11A in the present embodiment. However, the positions of the second focal points F2B of the plurality of portions E1, Ek, Em may be spaced apart from one another.

Accordingly, in the present embodiment, distances between the first focal points F1B and the second focal points F2B of the plurality of portions E1, Ek, Em are respectively substantially equal. Thus, in a case in which the reflective surface 233B has a shape in which the portions E1, Ek, Em of the plurality of ellipses are combined, the distances between the first focal points F1B and the second focal points F2B of the plurality of ellipses may be substantially equal. In this case, the ellipse of the plurality of ellipses having the shortest distance between the first focal point and the second focal point may be any of the ellipses constituting the plurality of portions E1, Ek, Em. In the present embodiment, for ease of explanation, the ellipse constituting the portion E1 is referred to as a "first ellipse." Thus, "having the shortest distance between the first focal point and the second focal point" in this specification includes both a case in which the values of the plurality of distances differ from one another and a distance having the smallest value among the plurality of distances is the "shortest distance," and a case in which the values of all distances are equal and this equal distance is the "shortest distance." Hereinafter, a distance between the first focal point F1B and the second focal point F2B is referred to as a "first distance D1B."

The reflective surface 233B intersects the axis E, that is, the major axis of the first ellipse. Hereinafter, the distance between the first focal point F1B of the first ellipse, that is, the portion E1, and an intersection point F0B of the major axis of the first ellipse and the reflective surface 233B is referred to as the "second distance D2B."

In the present embodiment, the value obtained by dividing the first distance D1B by the second distance D2B is 7 or greater. That is, D1B/D2B≥7. The maximum value obtained by dividing the first distance D1B by the second distance D2B is not particularly limited, but is 30 or less. That is, D1B/D2B≤30. The maximum value obtained by dividing the first distance D1B by the second distance D2B is not particularly limited, but is preferably 10 or less. That is, D1B/D2B≤10 is preferable.

The first distance D1B is not particularly limited, but is preferably in a range of 14 mm to 70 mm. The second distance D2B is not particularly limited, but is preferably in a range of 2 mm to 10 mm.

The outer surface 234B is curved in the same manner as the reflective surface 233B. The first end surface 235B is a flat surface and substantially parallel to the second direction X and the third direction Y, for example. The first end surface 235B is located below the intersection point F0B in the present embodiment. However, the position of the first end surface in the first direction may be the same as the position of the intersection point in the first direction.

The second end surface 236B is a flat surface and substantially parallel to the first direction Z and the third direction Y, for example.

However, the specific shapes of the outer surface, the first end surface, and the second end surface are not limited to the above.

As illustrated in FIG. 9, the attachment portion 232B protrudes upwardly from the main body portion 231B. A through-hole 237B is provided in the attachment portion 232B. A second drive member 260B is disposed in the through-hole 237B.

The second reflector 230B is primarily composed of a resin material, and the reflective surface 233B is provided with a reflective film such as a metal film or a dielectric multilayer film. However, the second reflector may also be composed of a metal material.

As described above, the reflective surface 233A of the first reflector 230A has a shape obtained by combining the portions B11 to B14, Bi1 to Bi4, and Bn1 to Bn4 of the outer peripheries of the plurality of ellipses. The reflective surface 233B of the second reflector 230B also has a shape obtained by combining the portions E1, Ek, Em of the outer peripheries of the plurality of ellipses. Note that "has a shape obtained by combining the portions of the outer peripheries of the plurality of ellipses" means that the reflective surface has a shape obtained by combining the portions of the outer peripheries of the plurality of ellipses at a practical level such that minor deviations from the portion of the outer periphery of each ellipse due to manufacturing error or the like are permitted.

Lens

The shapes of the first lens 240A and the second lens 240B are each substantially the same as the shape of the lens 140 in the first embodiment. However, in the present embodiment, the maximum dimension of the first lens 240A in the second direction X is greater than the maximum dimension of the second lens 240B in the second direction X. Thus, the focal length of the first lens 240A is shorter than the focal length of the second lens 240B. However, a size relationship between the maximum dimension of the first lens in the second direction and the maximum dimension of the second lens in the second direction is not limited to the above.

In the present embodiment, the focal point of the first lens 240A and the second focal points F2A of the reflective surface 233A of the first reflector 230A are located on the axis B. Then, a distance between the second focal point F2A of the portion B11 and the incident surface of the first lens 240A in the second direction X is less than or equal to a distance between the focal point of the first lens 240A and the incident surface of the first lens 240A in the second direction X. Accordingly, the other second focal point F2A of the first reflector is located closer to the first lens 240A than the focal point of the first lens 240A in the second direction X. As a result, as illustrated in FIG. 8, light L4*a* reflected by the portion B11 of the reflective surface 233A and exiting from the first lens 240A becomes parallel light or diffused light and is reflected by other portions of the reflective surface 233A, and light L4*b* exiting from the first lens 240A becomes diffused light. In this way, the first lens 240A can emit light primarily diffused in the first direction Z and the third direction Y.

The position of the focal point of the second lens 240B in the present embodiment generally coincides with the position of the second focal point F2B of the portion E1 of the reflective surface 233B of the second reflector 230B. Therefore, as illustrated by the arrow L5 in FIG. 9, primarily parallel light exits from the second lens 240B.

Light-Blocking Member

As illustrated in FIG. 8, the first light-blocking member 250A blocks a portion of light directed from the reflective surface 233A toward the first lens 240A in a state in which the first light-blocking member 250A is disposed between the reflective surface 233A of the first reflector 230A and the first lens 240A. In a case in which the lighting device 200 is applied to a headlamp of a vehicle such as an automobile, the first light-blocking member 250A can form a cutoff line for a low beam.

Similarly, as illustrated in FIG. 9, the second light-blocking member 250B blocks a portion of light directed from the reflective surface 233B toward the second lens 240B in a state in which the second light-blocking member 250B is disposed between the reflective surface 233B of the second reflector 230B and the second lens 240B. In a case in which the lighting device 200 is applied to a headlamp of a vehicle such as an automobile, the second light-blocking member 250B can form a cutoff line for a low beam.

From the viewpoint of suppressing an excessive reduction in maximum illuminance in the irradiation region while reducing the first lens 240A in size in the first direction Z, a distance in the second direction X between the incident surface of the first lens 240A and the first light-blocking member 250A is preferably in a range of 10 mm to 25 mm. The same applies to a distance between the second lens 240B and the second light-blocking member 250B.

Drive Member

The first drive member 260A switches between a first state in which the first light-blocking member 250A is disposed between the reflective surface 233A of the first reflector 230A and the first lens 240A, and a second state in which the first light-blocking member 250A is disposed in a position away from the area (i.e. absent) between the reflective surface 233A of the first reflector 230A and the first lens 240A. The first drive member 260A includes an actuator such as a solenoid or a motor. The first drive member 260A is fixed to the first reflector 230A. The first light-blocking member 250A is attached to the first drive member 260A and rotated around a rotation axis extending in the second direction X by the first drive member 260A.

The second drive member 260B switches between a first state in which the second light-blocking member 250B is disposed between the reflective surface 233B of the second reflector 230B and the second lens 240B, and a second state in which the second light-blocking member 250B is disposed in a position away from the area (i.e. absent) between the reflective surface 233B of the second reflector 230B and the second lens 240B. The second drive member 260B includes an actuator such as a solenoid or a motor. The second drive member 260B is fixed to the second reflector 230B. The second light-blocking member 250B is attached to the second drive member 260B and rotated around a rotation axis extending in the second direction X by the second drive member 260B.

The lighting device 200 may further include a control unit configured to control the first light source 220A, the second light source 220B, the first drive member 260A, and the second drive member 260B.

Next, operation of the lighting device 200 according to the present embodiment will be described.

In a case in which the lighting device 200 is applied to a headlamp of a vehicle such as an automobile or the like and a low beam is to be emitted from the lighting device 200, the control unit turns on the first light source 220A and the second light source 220B, and controls the first drive member 260A and the second drive member 260B to switch the first unit UA and the second unit UB to the first state. In this way, the cutoff line for a low beam is formed in the irradiation region of the light emitted from the lighting device 200. At this time, the light emitted from the first unit UA and the light emitted from the second unit UB overlap, thereby making it possible to improve the maximum illuminance in the irradiation region of the light emitted from the lighting device 200. In particular, light can be irradiated in a region that spreads in the first direction Z and the third direction Y by the first unit UA. The light emitted from the second unit UB is primarily parallel light, thereby making it possible to increase the maximum illuminance in the irradiation region of the light emitted from the lighting device 200.

In a case in which a high beam is to be emitted from the lighting device 200, the control unit turns on the first light source 220A and the second light source 220B, and controls the first drive member 260A and the second drive member 260B to switch the first unit UA and the second unit UB to the second state. At this time, the light emitted from the first unit UA and the light emitted from the second unit UB overlap, thereby making it possible to increase the maximum illuminance in the irradiation region of the light emitted from the lighting device 200.

Note that, in a case in which the lighting device is applied to a headlamp dedicated to a low beam, the lighting device need not include the first drive member or the second drive member, and the first light-blocking member and the second light-blocking member need not be movable. In a case in which the lighting device is applied to a headlamp dedicated to a high beam, the lighting device need not include the first light-blocking member, the second light-blocking member, the first drive member, or the second drive member. The lighting device need not include either the first unit or the second unit. The lighting device may also include three or more units.

Next, an effect of the present embodiment will be described.

The lighting device 200 according to the present embodiment includes the first light source 220A having the light-emitting surface 120*a*, the first reflector 230A having the reflective surface 233A configured to reflect light emitted from the first light source 220A, and the first lens 240A on which light reflected by the reflective surface 233A is incident. The reflective surface 233A has a shape obtained by combining the portions B11 to B14, Bi1 to Bi4, and Bn1 to Bn4 of the outer peripheries of the plurality of ellipses. The first focal point F1A of each of the plurality of ellipses is located on the light-emitting surface 120*a*. The second focal point F2A of each of the plurality of ellipses is located between the reflective surface 233A and the first lens 240A. The major axis (axis B) of, among the plurality of ellipses, the first ellipse and the reflective surface 233A intersect each other, the first ellipse having the shortest distance between the first focal point F1A and the second focal point F2A. The value obtained by dividing the first distance D1A between the first focal point F1A and the second focal point F2A of the first ellipse by the second distance D2A between the first focal point F1A of the first ellipse and the intersection point F0A of the reflective surface 233A and the major axis (axis B) is 7 or greater. The maximum dimension of the first lens 240A in the first direction Z in which the normal line N extends at the center C of the light-emitting surface 120*a* is 20 mm or less. As a result, it is possible to realize the first lens 240A having a short dimension in the first direction Z without changing the amount of light entering into the first lens 240A.

Similarly, the lighting device 200 according to the present embodiment includes the second light source 220B having the light-emitting surface 120*a*, the second reflector 230B having the reflective surface 233B configured to reflect light emitted from the second light source 220B, and the second lens 240B on which light reflected by the reflective surface 233B is incident. The reflective surface 233B has a shape obtained by combining the portions E1, Ek, Em of the outer peripheries of the plurality of ellipses. The first focal point F1B of each of the plurality of ellipses is located on the light-emitting surface 120*a*. The second focal point F2B of each of the plurality of ellipses is located between the reflective surface 233B and the second lens 240B. The major axis (axis E) of, among the plurality of ellipses, the first ellipse and the reflective surface 233B intersect each other, the first ellipse having the shortest distance between the first focal point F1B and the second focal point F2B. The value obtained by dividing the first distance D1B between the first focal point F1B and the second focal point F2B of the first ellipse by the second distance D2B between the first focal point F1B of the first ellipse and the intersection point F0B of the reflective surface 233B and the major axis (axis E) is 7 or greater. The maximum dimension of the second lens 240B in the first direction Z in which the normal line N extends at the center C of the light-emitting surface 120*a* is 20 mm or less. As a result, it is possible to achieve the second lens 240B having a short dimension in the first direction Z without changing the amount of light entering into the second lens 240B.

As described above, in a case in which the lighting device 200 is applied to a vehicle lamp such as a headlamp or the like, for example, the dimensions of the first lens 240A and the second lens 240B in the first direction Z are shortened, thereby improving the degree of freedom in design and making it possible to improve the design and/or functionality of the vehicle.

EXAMPLES

Next, examples and reference examples will be described.

As shown in Table 1 below, in the lighting devices according to Reference Examples 1 to 4 and the lighting devices according to Examples 1 and 2, the required dimension of the lens in the first direction Z and the illuminance of lamp were investigated. Note that a luminous flux (1 m) can be measured by, for example, using a CIE127 compliant integrating sphere. The illuminance of lamp (lx) can be measured using an illuminance meter (for example, the illuminance meter T-10A made by Konica Minolta).

TABLE 1

| | Reference Example 1 | Reference Example 2 | Reference Example 3 | Reference Example 4 | Example 1 | Example 2 |
|---|---|---|---|---|---|---|
| Type of light source | LED | LED | LED | LD | LD | LD |
| Luminance of light source (cd/mm$^2$) | 100 | 100 | 100 | 700 | 700 | 700 |
| Size of light-emitting surface (mm × mm) | 1.0 × 3.5 | 1.0 × 3.5 | 1.0 × 3.5 | 0.5 × 1.0 | 0.5 × 1.0 | 0.5 × 1.0 |
| Luminous flux of light source (lm) | 1230 | 1230 | 1230 | 1360 | 1360 | 1360 |
| First distance D1B (mm) | 15 | 21 | 27 | 15 | 21 | 27 |
| Second distance D2B (mm) | 3 | 3 | 3 | 3 | 3 | 3 |
| D1B/D2B | 5 | 7 | 9 | 5 | 7 | 9 |
| Required dimension of lens in first direction (mm) | 70 | 60 | 50 | 30 | 20 | 10 |
| Illuminance of lamp (1×) | 32 | 28 | 23 | 165 | 150 | 120 |

The lighting devices according to Reference Examples 1 to 4 and Examples 1 and 2 were each provided with a light source, a reflector, and a lens.

The light sources used in Reference Example 1, Reference Example 2, and Reference Example 3 each included an LED as the light-emitting element, and had a luminance of 100 cd/mm$^2$, a dimension of the light-emitting surface in the second direction X of 1.0 mm, a dimension of the light-emitting surface in the third direction Y of 3.5 mm, and a luminous flux of 1230 lm.

The reflectors used in Reference Example 1, Reference Example 2, and Reference Example 3 had the same shape as that of the second reflector 230B of the second embodiment. However, the reflectors used in Reference Example 1, Reference Example 2, and Reference Example 3 had first distances D1B different from one another. Specifically, the first distance D1B in Reference Example 1 was 15 mm. The first distance D1B in Reference Example 2 was 21 mm. The first distance D1B in Reference Example 3 was 27 mm. The second distance D2B in Reference Example 1, Reference Example 2, and Reference Example 3 was 3 mm. Thus, in Reference Example 1, D1B/D2B=5. In Reference Example 2, D1B/D2B=7. In Reference Example 3, D1B/D2B=9.

The light source used in Reference Example 4, Example 1, and Example 2 each included an LD as the light-emitting element, and had a luminance of 700 cd/mm$^2$, a dimension of the light-emitting surface in the second direction X of 0.5 mm, a dimension of the light-emitting surface in the third direction Y of 1.0 mm, and a luminous flux of 1360 lm. That is, the light source used in Reference Example 4, Example 1, and Example 2 had substantially the same luminous flux as that of the light source used in Reference Example 1, Reference Example 2, and Reference Example 3, but a smaller light-emitting surface size and higher luminance.

In Reference Examples 1 to 4, Example 1, and Example 2, the distance between the incident surface of the lens and the second focal point of the first ellipse of the reflector in the second direction X was 20 mm.

The reflectors used in Reference Example 4, Example 1, and Example 2 had the same shape as that of the second reflector 230B of the second embodiment. However, the reflectors used in Reference Example 4, Example 1, and Example 2 had first distances D1B different from one another. Specifically, the first distance D1B in Reference Example 4 was 15 mm. The first distance D1B in Example 1 was 21 mm. The first distance D1B in Example 2 was 27 mm. The second distance D2B in Reference Example 4, Example 1, and Example 2 was 3 mm. Accordingly, in Reference Example 4, D1B/D2B=5. In Example 1, D1B/D2B=7. In Example 2, D1B/D2B=9.

In each of the lighting devices configured as described above, the required dimension of the lens in the first direction Z was investigated. As a result, the results shown in the table above were obtained. Specifically, the required dimension of the lens in the first direction Z in Reference Example 1 was 70 mm. The required dimension of the lens in the first direction Z in Reference Example 2 was 60 mm. The required dimension of the lens in the first direction Z in Reference Example 3 was 50 mm. The required dimension of the lens in the first direction Z in Reference Example 4 was 30 mm. The required dimension of the lens in the first direction Z in Example 1 was 20 mm. The required dimension of the lens in the first direction Z in Example 2 was 10 mm.

Thus, it was found that increasing D1B/D2B tends to reduce the required dimension of the lens in the first direction Z. In particular, in Examples 1 and 2 in which the value of D1B/D2B was 7 or greater, the required dimension of the lens of the first direction Z could be set to 20 mm or less. That is, a sufficiently thin lens could be realized in the field of headlamps for vehicles such as automobiles.

On the other hand, in Reference Examples 1 to 3, the required dimension of each of the lenses in the first direction Z exceeded 20 mm. This is because the dimension in the second direction X of the light-emitting surface used in Reference Examples 1 to 3 was larger than the dimension in the second direction X of the light-emitting surface used in Examples 1 and 2, and the required dimension of the lens in the first direction Z increased accordingly.

In each of the lighting devices configured as described above, the maximum illuminance in the irradiation region of light on the screen in a case in which the screen was placed 25 m from the lens of each lighting device was investigated. Here, the maximum illuminance in the irradiation region of light on the screen is referred to as a "illuminance of lamp." As a result, the results shown in the table above were obtained. Specifically, the illuminance of lamp in Reference Example 1 was 32 lx. The illuminance of lamp in Reference Example 2 was 28 lx. The illuminance of lamp in Reference Example 3 was 23 lx. In a headlamp of a vehicle such as an automobile, the required illuminance of lamp is about 130 lx. Accordingly, in the lighting devices in Reference Examples 1 to 3, it was found that the illuminance of lamp required for headlamps was not achieved with only one unit.

It was found that the illuminance of lamp tends to decrease as the value of D1B/D2B increases. The reason is that, as described in the first embodiment, as the value of D1B/D2B increases, the irradiation region of light on the second focal point F2B spreads, and the maximum illuminance decreases accordingly.

In contrast, the luminance of the light source in Reference Example 4, Example 1, and Example 2 was 7 times the luminance of the light source in Reference Examples 1 to 3. Thus, the illuminance of lamp in Reference Example 4 was 165 lx. The illuminance of lamp in Example 1 was 150 lx. The illuminance of lamp in Example 2 was 120 lx. In Example 2, the illuminance of lamp was less than 130 lx. However, as long as the first unit UA is further provided as in the lighting device 200 according to the second embodiment, the illuminance of lamp of the lighting device as a whole can be increased to 130 lx or greater. In this case, the illuminance of lamp in Example 2 is sufficiently higher than each illuminance of lamp in Reference Examples 1 to 3. Therefore, it was found that the number of units required to make the lamp having illuminance of 130 lx or greater in Example 2 was significantly less than the number of units required to make each lamp having illuminance of 130 lx or greater in Reference Examples 1 to 3.

As described above, it was found that, in Examples 1 and 2, a light source having a luminance higher than that of the light source of Reference Examples 1 to 3 was used and thus, even if the value of D1B/D2B was increased, a lighting device having the lamp illuminance required for a headlamp, for example, could be achieved with a small number of units.

Embodiments of the present disclosure can be utilized in a vehicle lamp such as a headlamp, for example.

The invention claimed is:

1. A lighting device comprising:

a light source comprising a laser diode and having a light-emitting surface;

a reflector having a reflective surface configured to reflect light emitted from the light source; and a lens on which light reflected by the reflective surface is incident, wherein:

the reflective surface is composed of a portion of a spheroidal surface that includes a first focal point located on the light-emitting surface and a second focal point located between the reflective surface and the lens, the reflective surface intersects a major axis of the spheroidal surface, a value obtained by dividing a first distance, which is a distance between the first focal point and the second focal point, by a second distance, which is a distance between the first focal point and an intersection point of the reflective surface and the major axis, is 7 or greater, and a maximum dimension of the lens in a first direction in which a normal line extends at a center of the light-emitting surface is 20 mm or less.

2. The lighting device according to claim 1, wherein a maximum dimension of the light-emitting surface in a second direction in which the major axis extends is in a range of 0.2 mm to 1.0 mm.

3. The lighting device according to claim 1, wherein the light source has a luminance in a range of 300 cd/mm$^2$ to 2500 cd/mm$^2$.

4. The lighting device according to claim 1, wherein the lens has:

an incident surface on which light reflected by the reflective surface is incident, an emission surface located on a side opposite the incident surface and configured to emit light transmitted from the incident surface, a first flat surface located between the incident surface and the emission surface, and a second flat surface located on a side opposite the first flat surface in the first direction and located between the incident surface and the emission surface.

5. The lighting device according to claim 1, wherein a maximum dimension of the lens in the first direction is 3.0 mm or greater.

6. The lighting device according to claim 1, wherein the lighting device is a vehicle lamp.

7. The lighting device according to claim 1, wherein:

the reflector is located only above the light-emitting surface; and a center of the lens in the first direction is located under the light-emitting surface.

8. A lighting device comprising:

a light source comprising a laser diode and having a light-emitting surface;

a reflector having a reflective surface configured to reflect light emitted from the light source; and a lens on which light reflected by the reflective surface is incident, wherein:

the reflective surface has a shape obtained by combining portions of outer peripheries of a plurality of different ellipses, a first focal point of each of the plurality of different ellipses is located on the light-emitting surface, a second focal point of each of the plurality of different ellipses is located between the reflective surface and the lens, a major axis of (i) a first ellipse that has a shortest distance between the first focal point and the second focal point among the plurality of different ellipses, intersects (ii) the reflective surface, a value obtained by dividing a first distance, which is a distance between the first focal point and the second focal point of the first ellipse, and a second distance, which is a distance between the first focal point of the first ellipse and an intersection point of the reflective surface and the major axis, is 7 or greater, and a maximum dimension of the lens in a first direction in which a normal line extends at a center of the light-emitting surface is 20 mm or less.

9. The lighting device according to claim 8, wherein a maximum dimension of the light-emitting surface in a second direction in which the major axis extends is in a range of 0.2 mm to 1.0 mm.

10. The lighting device according to claim 8, wherein the light source has a luminance in a range of 300 cd/mm$^2$ to 2500 cd/mm$^2$.

11. The lighting device according to claim 8, wherein:

the lens has:

an incident surface on which light reflected by the reflective surface is incident an emission surface located opposite the incident surface and configured to emit light transmitted from the incident surface, a first flat surface located between the incident surface and the emission surface, and a second flat surface located opposite the first flat surface in the first direction and located between the incident surface and the emission surface.

12. The lighting device according to claim 8, wherein a maximum dimension of the lens in the first direction is 3.0 mm or greater.

13. The lighting device according to claim 8, wherein the lighting device is a vehicle lamp.

14. The lighting device according to claim 8, wherein a distance between (i) the first focal point and (ii) the second focal point of a first of the plurality of different ellipses that is farthest from the lens, is shorter than a distance between (iii) the first focal point, and (iv) the second focal point of a second of the plurality of different ellipses.

15. The lighting device according to claim 8, wherein:

the reflector is located only above the light-emitting surface; and a center of the lens in the first direction is located under the light-emitting surface.

16. The lighting device according to claim 8, wherein the reflective surface is divided into a plurality of regions along the major axis of the first ellipse, and each of the plurality of regions is a part of a respective one of the plurality of different ellipses.

17. The lighting device according to claim 8, wherein the reflective surface is divided into a plurality of regions along the circumferential direction of the first ellipse, and each of the plurality of regions is a part of a respective one the plurality of different ellipses.

* * * * *